US010161158B2

(12) United States Patent
Mummert

(10) Patent No.: US 10,161,158 B2
(45) Date of Patent: Dec. 25, 2018

(54) COMBINATION UMBRELLA AND COVER

(71) Applicant: Mumco Ltd., Escondido, CA (US)

(72) Inventor: Scott A. Mummert, Escondido, CA (US)

(73) Assignee: Mumco Ltd., San Marcos, CA (US)

( * ) Notice: Subject to any disclaimer, the term of this patent is extended or adjusted under 35 U.S.C. 154(b) by 0 days.

(21) Appl. No.: 15/940,902

(22) Filed: Mar. 29, 2018

(65) Prior Publication Data

US 2018/0283038 A1 Oct. 4, 2018

Related U.S. Application Data

(60) Provisional application No. 62/486,942, filed on Apr. 18, 2017, provisional application No. 62/478,592, filed on Mar. 29, 2017.

(51) Int. Cl.

| | |
|---|---|
| ***E04H 15/28*** | (2006.01) |
| ***A45B 25/14*** | (2006.01) |
| ***A45B 25/18*** | (2006.01) |
| *A45B 23/00* | (2006.01) |

(52) U.S. Cl.

CPC ..... *E04H 15/28* (2013.01); *A45B 25/14* (2013.01); *A45B 25/18* (2013.01); *A45B 2023/0012* (2013.01); *A45B 2023/0093* (2013.01); *A45B 2200/1072* (2013.01)

(58) Field of Classification Search

CPC ..... A45B 25/02; A45B 25/06; A45B 25/14; A45B 25/18; A45B 2200/1063; A45B 2023/0093; A45B 2200/1072; A45B 2023/0012; E04H 15/28

USPC ..... 135/16, 98–99, 20.3, 22–23, 27–32; 211/197; 108/50.12

See application file for complete search history.

(56) References Cited

U.S. PATENT DOCUMENTS

| | | | | |
|---|---|---|---|---|
| 373,378 A | | 11/1887 | Rumville | |
| 645,704 A | * | 3/1900 | Downs | E04H 15/28 135/120.2 |
| 1,072,340 A | * | 9/1913 | Liljegran | A01G 13/043 135/23 |
| 1,774,909 A | | 9/1930 | Wells | |

(Continued)

FOREIGN PATENT DOCUMENTS

| | | |
|---|---|---|
| CN | 103504739 A | 1/2014 |
| DE | 4037087 A1 | 5/1992 |

(Continued)

*Primary Examiner* — Winnie Yip

(74) *Attorney, Agent, or Firm* — Mastermind IP Law P.C.; Diane L. Gardner

(57) ABSTRACT

Disclosed herein is a large umbrella configured to solve several existing deficiencies. The umbrella is configured for ease of operation, requiring very little effort for operation. This is achieved, in part, by use of a specially designed actuator arm used in conjunction with at least one pulley and counterbalanced weight system. Moreover, the umbrella canopy and framework is configured to allow the entire canopy to be lowered while remaining fully extended, so as to form a cover for a table into which its center pole is situated. Additionally, the umbrella canopy can be constructed with an extendible skirt. When unfurled, the skirt can extend the canopy cover so as to form an enclosure that fully surrounds the table, table legs, and chairs, for example.

21 Claims, 17 Drawing Sheets

(56) References Cited

U.S. PATENT DOCUMENTS

| | | | | | |
|---|---|---|---|---|---|
| 1,801,913 | A * | 4/1931 | Frederick | E04H 15/28 | 135/98 |
| 2,502,984 | A | 4/1950 | Parmenter | | |
| 2,546,228 | A | 3/1951 | Martini | | |
| 2,661,849 | A * | 12/1953 | Spalding | D06F 57/04 | 135/15.1 |
| 2,863,467 | A | 12/1958 | Hearell | | |
| 3,419,024 | A | 12/1968 | Nickerson | | |
| 3,477,453 | A | 11/1969 | D'Ulisse | | |
| 4,033,366 | A | 7/1977 | Forget | | |
| 4,510,955 | A | 4/1985 | Hermanson | | |
| 4,685,482 | A | 8/1987 | Yung | | |
| 5,172,712 | A | 12/1992 | Robinson | | |
| 5,492,232 | A * | 2/1996 | Ohm | D06F 57/04 | 135/20.3 |
| 5,740,822 | A | 4/1998 | Einck | | |
| 5,806,547 | A * | 9/1998 | Derlinga | A45B 23/00 | 135/117 |
| 5,871,024 | A * | 2/1999 | Vanderminden, Sr. | A45B 17/00 | 135/155 |
| 5,941,261 | A * | 8/1999 | Kouvaras | A45B 25/22 | 135/23 |
| 6,202,660 | B1 * | 3/2001 | Steiner | A45B 23/00 | 135/22 |
| 6,732,753 | B2 * | 5/2004 | Chang | A45B 25/14 | 135/20.3 |
| 7,775,382 | B2 | 8/2010 | Wuster | | |
| 8,079,378 | B1 * | 12/2011 | Derlinga | A45B 23/00 | 135/16 |
| 8,087,420 | B1 | 1/2012 | Lukacsy | | |
| 9,462,860 | B1 | 10/2016 | Whetstone | | |
| 2002/0108645 | A1 | 8/2002 | Beyer | | |
| 2003/0089388 | A1 * | 5/2003 | Cassagne | A45B 25/14 | 135/25.32 |
| 2006/0005871 | A1 | 1/2006 | Church | | |
| 2008/0190468 | A1 | 8/2008 | Labarbera | | |
| 2011/0240073 | A1 | 10/2011 | Reid | | |
| 2012/0006370 | A1 | 1/2012 | Liljekvist | | |
| 2012/0273016 | A1 | 11/2012 | Pandak | | |
| 2013/0167890 | A1 | 7/2013 | Brown | | |
| 2014/0360541 | A1 | 12/2014 | Beyer | | |

FOREIGN PATENT DOCUMENTS

| | | | | |
|---|---|---|---|---|
| ES | 2837773 | U | 1/1985 | |
| JP | 2003159108 | A | 11/2001 | |
| WO | WO-9300840 | A1 * | 1/1993 | A45B 3/00 |
| WO | 201610175 | A1 | 1/2016 | |

* cited by examiner

COMBINATION UMBRELLA AND COVER

This application claims the benefit of U.S. Provisional Patent Application No. 62/486,942 filed on Apr. 18, 2017 and U.S. Provisional Patent Application No. 62/478,592 filed on Mar. 29, 2017.

BACKGROUND

Umbrellas are designed to restrict or block, for example, rain, wind, and/or sunlight. Large umbrellas typically are used on patios and decks, and at yard, courtyard, sidewalk, and beach settings. Often, large umbrellas remain in a fixed location and typically they are constructed with a large center pole. Many tables intended for outdoor use are designed to incorporate a hole in the center of the table top so as to accept and incorporate the center pole of a large umbrella.

While there are many mechanical configurations for large umbrellas, the umbrellas remain difficult to operate. For example, significant force is required to extend and collapse the umbrella canopy using traditional hand-crank/gear designs. Other configurations incorporate one or more pulleys that can be complicated to manufacture, while unsuccessfully achieving ease of installation and/or operation. Yet other designs incorporate weights into the configuration, nevertheless requiring significant exertion of force on the part of the operator.

When not in use, outdoor furniture often is covered as a means of protecting the furniture from the elements, and to keep the furniture free from dust, dirt, and debris. In many cases, the furniture and/or large umbrella incorporated therein must be dissembled in order for the furniture to be fitted with standard outdoor furniture covers.

SUMMARY OF THE INVENTION

Disclosed herein is an umbrella configured to solve several existing deficiencies. The umbrella is configured for ease of operation, requiring very little effort on the part of the operator, even when constructed as a relatively large umbrella. This is achieved, in part, by use of a specially designed actuator arm used in conjunction with at least one pulley and counterbalanced weight system.

Moreover, the umbrella canopy and framework is configured to allow the entire canopy to be lowered while remaining fully extended, so as to form a cover for a table into which its center pole is situated. Additionally, the umbrella canopy can be constructed with an extendible skirt. When unfurled, the skirt can extend the canopy cover so as to form an enclosure that fully surrounds the table, table legs, and chairs, for example.

DETAILED DESCRIPTION

Figures 1, 1A:
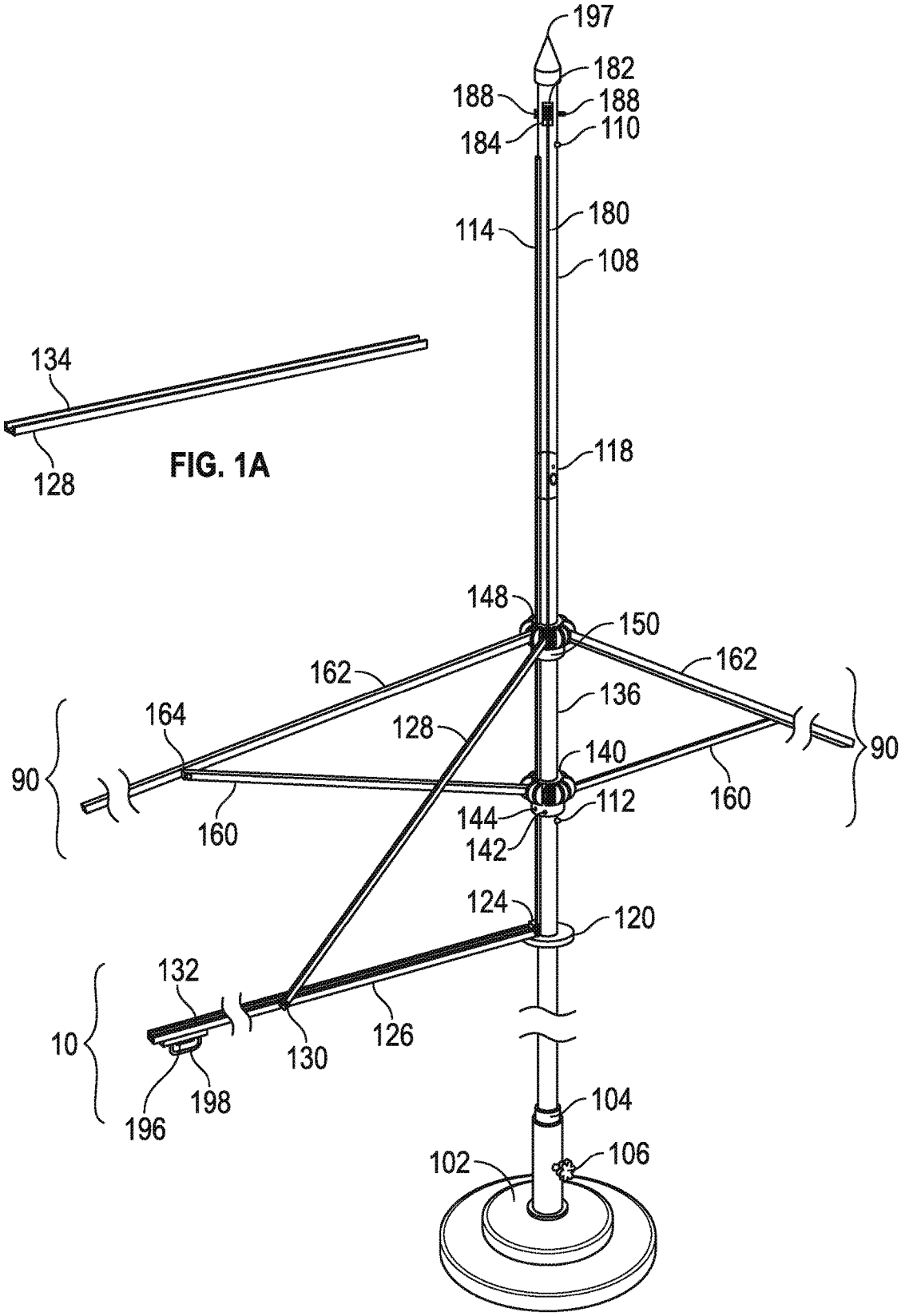
FIG. 1 shows major components of the umbrella frame including the actuator, two representative struts, sliding sleeve, sliding rail, upper and lower canopy supports, and pulley mechanism, wherein the actuator arms and the strut arms are offset at their pivot connections.
FIG. 1A shows the underside of the upper actuator arm in FIGS. 1, 4, and 7 so that the upper actuator arm channel is visible.

The terms "a" and "an" and variations thereof represent the phrase "at least one." In all cases, the terms "comprising," "comprises," "including," "includes," "contains," "having," and any variations thereof should not be interpreted as limited to the elements listed thereafter but rather as open-ended terms, as though the phrase "at least" were appended thereafter.

The conjunction "or" is to be construed inclusively (i.e., one, another, or both), unless it is explicitly stated otherwise (e.g., by use of "either . . . or," "only one of," or similar language) or two or more of listed alternatives are mutually exclusive within the particular context, in which case "or" would encompass only those combinations involving non-mutually exclusive alternatives.

The term "substantially" is to be construed as meaning something that effectively possesses the same property or achieves the same function as that of the stated limit, and includes exactly the stated limit as well as insignificant deviations therefrom.

The term "approximately" is to be construed as meaning something having very nearly the stated value, and includes exactly the stated value as well as insignificant variations therefrom.

Unless otherwise specified, all words used herein carry their common meaning as understood by a person having ordinary skill in the art. In cases where examples are listed, it is to be understood that combinations of any of the alternative examples are also envisioned. The scope of the invention is not to be limited to the particular embodiments disclosed herein, which serve merely as examples representative of the limitations recited in the issued claims resulting from this application, and the equivalents of those limitations.

Various features may be grouped together in example embodiments for the purpose of streamlining the disclosure, but this method of disclosure should not be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the detailed description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. Conversely, the scope of the appended claims does not necessarily encompass the whole of the subject matter disclosed herein.

If the word "means" or the phrase "step for" does not appear in a claim, applicant does not intend to invoke the provisions of law relating to "means/function" or "step/function" claiming.

The abstract is provided as required as an aid to those searching for specific subject matter within the patent literature. However, the abstract is not intended to imply that any elements, features, or limitations recited therein are necessarily encompassed by any particular claim. The scope of subject matter encompassed by each claim shall be determined by the recitation of only that claim.

Certain elements of the umbrella include standard components that are readily apparent to any person having ordinary skill in the art. These components may be selected based upon the appropriateness of the materials from which they are made as well as features relating to their overall aesthetic appeal.

For example, the umbrella typically includes a base 102. The base 102 may be selected from a variety of shapes such that the overall design enables the central portion of the base 102 to accept the bottom portion of a pole 108 inserted into the top of the base 102, to extend downward vertically into the base 102, and to be held secure. The base 102 may include at least one base fitting sleeve 104 in order to accommodate a pole 108 having a circumference significantly smaller than the insertion point in the base 102, and optionally may be fitted with a base tightening screw 106 for added security and to prevent rotation of the pole 108. The base 102 may be weighted to prevent side-to-side movement of the pole 108, especially when strong winds exert force on the canopy 168. Selection of appropriate styles and materials for the base 102 are readily apparent to any person having ordinary skill in the art. The pole 108 comprises a cylindrical wall having inner and outer sides having a top portion, an elongated middle portion, and a bottom portion.

Figure 14:
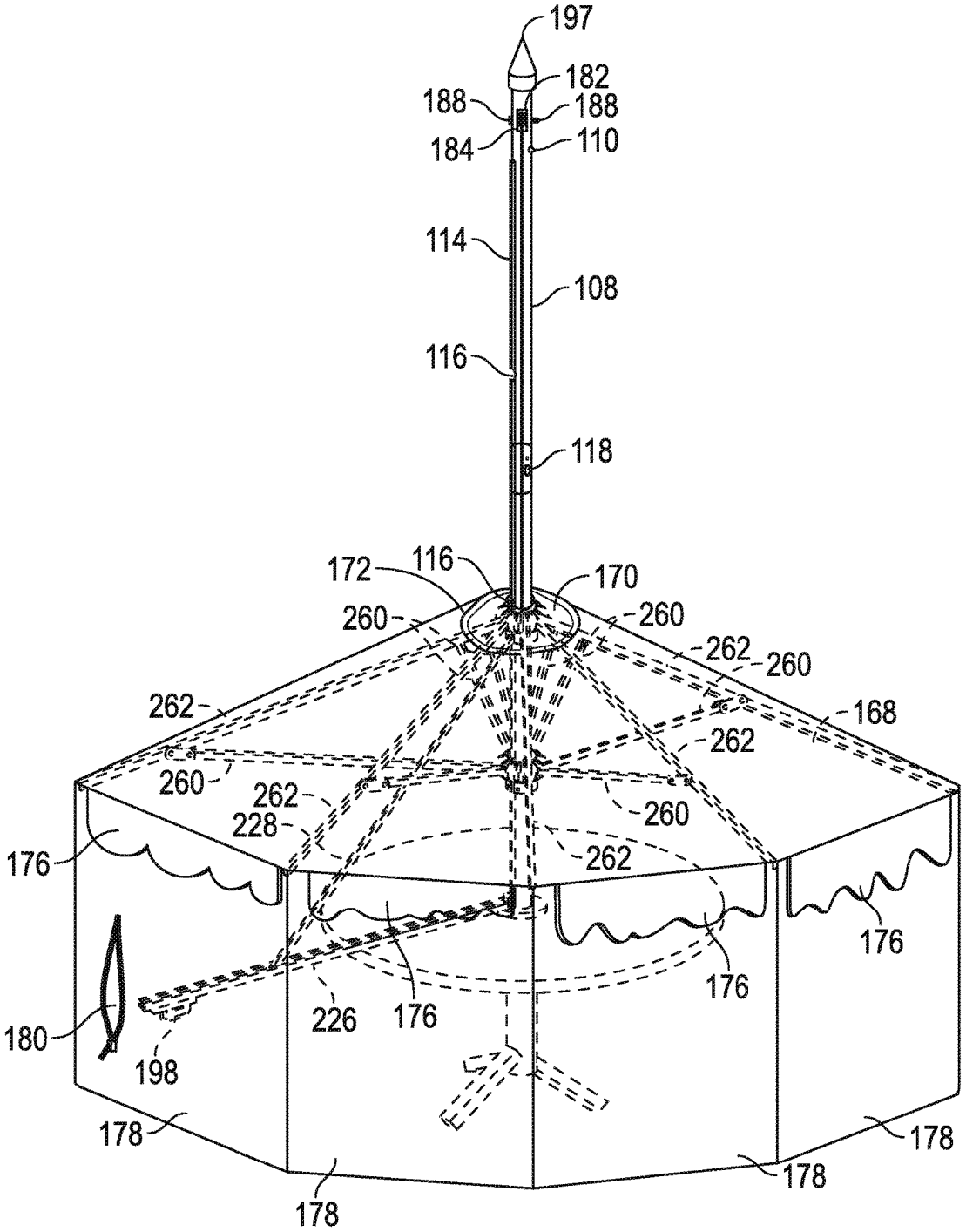
FIG. 14 shows additional components and optional components of the umbrella, including the canopy and vent flap, tilting mechanism, valance, skirt, and finial (not to scale).

The umbrella typically includes a canopy 168 supported by struts 90, 92, as shown in FIG. 14 (not to scale). The canopy 168 may be selected from a variety of shapes such that it is fully supported by an appropriate number of substantially evenly spaced struts 90, 92 extending from approximately the outer edge of the canopy 168 periphery to the central portion of the framework at the pole 108. The canopy 168 may be manufactured from a variety of materials selected with regard to factors readily apparent to any person having ordinary skill in the art, including but not limited to overall durability, for example, sun, wind, and water resistance, overall weight, intended function, and overall aesthetic appeal. Typical materials include, but are not limited to cold rolled steel, hot rolled steel, stainless steel, and aluminum.

The canopy 168 may be supported by the struts 90, 92 in a fixed or moveable manner. For example, the canopy 168 may be attached directly onto the top side of the struts 90, 92, for example, by nails, screws, rivets, or bolts (not shown). The canopy 168 may have a means for reinforcement of the canopy 168 material at the point of attachment, such as metal grommets (not shown). In a preferred embodiment, the struts 90, 92 are inserted into strut pockets (not shown) sewn into the underside of the canopy 168 near its periphery, the pockets having the open ends facing toward the pole 108 in order to accept the struts 90, 92 radiating outward therefrom. The manner for supporting the canopy 168 by the struts 90, 92 typically results in the struts 90, 92 terminating near the outermost periphery of the canopy 168 and serving to stretch the canopy 168 taut when fully extended.

In some embodiments, the central pole 108 terminates at the underside of the canopy 168, and the canopy 168 is continuous from edge to edge. In another embodiment shown in FIG. 14, the central portion of the canopy 168 constitutes a canopy hole 170 that is transected by the pole 108 extending upward through the canopy 168, whereby the inner circumference of the canopy 168 rests along the struts 90, 92, and wherein the pole 108 is located in the central portion of the canopy hole 170. In this case, a vent flap 172 is used in conjunction with the canopy 168, as discussed further herein.

Where a vent flap 172 is incorporated into the design, it is connected to the top portion of the upper canopy support 148, 248, 348 by any means deemed reasonable by a person having ordinary skill in the art. For example, the inner portion of the vent flap 172 may be connected by a reversible means, such as with substantially evenly placed snap closures 174. As used herein, the term "reversible" indicates that the connection is not permanent and may be connected and disconnected repeatedly. The outermost edge of the vent flap 172 is partially joined to the canopy 168. For example, the vent flap 172 typically is stitched to the canopy 168 at substantially equal intervals close enough together to allow the vent flap 172 to provide protection for the area exposed by the canopy hole 170, while allowing for circulation of air under the areas that remain unattached. Incorporation of a vent flap 172 is considered well within the skill of the art.

As shown in FIG. 14, the canopy 168 may include an optional skirt 178 attached at the periphery of the canopy 168. The skirt may consist of a single unit, or multiple panels that may be reversibly connected after unfurling, for example, with one or more zippers, buttons, snaps, hooks, hook and eye connectors, hook and loop connectors, magnets, or ties (not shown). The skirt 178 may be attached to the canopy 168 in a fixed or removable manner. For example, the skirt 178 may be sewn directly to the canopy 168 at its periphery. In another embodiment, the skirt 178 may be reversibly attached to the canopy 168, for example, by one or more zippers, buttons, snaps, hooks, hook and eye connectors, hook and loop connectors, magnets, or ties (not shown). In each case of attachment, it is generally considered more aesthetically pleasing for the seams or connectors to be visible only from the underside of the canopy 168. Means and methods for attachment of a canopy skirt 178 are considered to be readily apparent to any person having ordinary skill in the art.

It is to be understood that any such skirt 178 should extend substantially vertically downward from the outer periphery of the canopy 168, as shown in FIG. 14. The skirt 178 may extend straight downward, or it may be designed to flare outward such that its bottom perimeter is larger than its top perimeter and/or canopy 168 perimeter. The length of the skirt 178 should be determined based upon its desired function. For example, if the skirt 178 is intended to function as a shelter from insects, the skirt 178 should be appropriate in length to extend from the canopy 168 in its raised position, downward to the ground, forming a tent-like structure. Where the skirt 178 is intended to operate as a protective covering for furniture, the length of the skirt 178 should be appropriate to extend from the outer periphery of the canopy 168 in its lowered position, downward around the furniture to be protected, and onward to the ground, as shown in FIG. 14.

The skirt 178 material may be selected based upon its intended function. For example, a skirt intended to be used for protection against insects might be constructed from durable mesh material, e.g., mosquito netting. A skirt 178 intended to function as a protective covering for furniture may be made of material similar to that of the canopy 168. Examples of appropriate materials include, but are not limited to natural or synthetic materials including cotton, canvas, nylon, and acrylic.

Optionally, such a skirt 178 can include an opening 180 in its side, as shown in FIG. 14. For example, where the skirt 178 is used as protection from insects, the opening (not shown) may serve for entering and exiting the enclosure when the skirt 178 is fully unfurled. The length of such opening should be suitable for allowing an adult to comfortably enter and exit the enclosure. Therefore, the opening should begin at the bottom of the skirt 178 and extend an appropriate length upward. Optionally, the opening may extend vertically along the full length of the skirt 178, terminating near the point of attachment to the canopy 168. In a skirt 178 comprised of multiple adjoining panels, each of the reversible panel connections may serve as an entryway.

In another example shown in FIG. 14, the skirt 178 is used as a protective covering for furniture, and the opening 180 may serve to allow access to the actuator 10, 20 used to raise and lower the canopy 168. In this case, the opening 180 need only extend along the portion of the side of the skirt 178 opposing the lower actuator arm 126, 226 (in the lowered position) in a length appropriate to enable its access and operation. Typically, when the lower actuator arm 126, 226 is fully lowered, the top of the opening 180 would be at or near the top of the top of the skirt 178, and would extend downward sufficiently to enable operation of the lower actuator arm 126, 226 upward, thus moving the canopy 168 and skirt 178 upward as well. Once the canopy 168 and skirt 178 are raised partially to an appropriate level, the operator may remove or furl the skirt 178, and then raise the lower actuator arm 126 and canopy 168 to the full upright positions. The lower actuator arm 126 may be fully enclosed by the skirt 178 when they are in the lowered position, or it may extend through the opening 180.

Useful styles of openings are readily apparent to any person having ordinary skill in the art, and may be designed according to a variety of shapes and styles. In one embodiment, the opening is a slit having two sides of the opening meeting at their opposing edges. In another embodiment, the opening is a slit having two opposing sides of the opening overlapping to form a natural closure. Other embodiments may take the form of more elaborate designs, for example, where the opening has more than one pair of opposing sides, such as in the shape of a door.

The opening 180 optionally may include a means for sealing or securing the opening (not shown), such as with buttons, snaps, hooks, hook and eye connectors, hook and loop connectors, magnets, zippers, or ties.

The skirt 178 optionally may include a means for maintaining it in the downward position (not shown). For example, weighted material may be sewn into the hem along the bottom. Alternatively, the bottom hem may include external fasteners, such as loops, cords, or ties for connecting to one or more stationary objects. In another embodiment, a drawstring may be included in the hem to enable the skirt 178 to be gathered at the bottom and secured.

The skirt 178 may be retractable. Means and methods for retracting fabric are readily apparent to any person having skill in the art, and may be accomplished manually or mechanically. For example, the skirt 178 may be retracted by one or more drawstrings (not shown), such as in the manner of window blinds. Alternatively, the skirt 178 may be retracted with a combination of sidewinders and ratchets (not shown), such as in the manner of window shades. In another embodiment, mechanical means (not shown) for retraction may be motorized.

In the simplest of configurations, the skirt 178 may be retracted by manually gathering, folding, and/or rolling it toward the canopy 168 such that in its retracted position it is snug against the canopy 168. In a preferred embodiment, it is rolled inward and upward toward the canopy 168 so that it is positioned on the underside of the canopy 168 when it is retracted. Once retracted, the skirt 178 may be held in place, for example, by fasteners fitted with buttons, snaps, hook and eye connectors, hook and loop connectors, hooks, or ties (not shown). In one embodiment, the means used for securing the bottom of the skirt 178 in the unfurled position may double as the means used for securing the skirt 178 to the canopy 168 in the retracted position.

The skirt 178 may be configured to roll up or fold into a closable container located on the underside of the canopy 168, such as one or more cylindrical bags (not shown). Alternatively, the container may be sewn or otherwise attached to the skirt 178 itself, on the outer side at the top near the canopy 168. Where the container is sewn onto the skirt 178, it can be inverted around the skirt 178 after the skirt 178 is retracted, and optionally secured with a fastener.

The canopy 168 may include one or more valances 176 extending downward from its periphery, as seen in FIG. 14. Where the canopy 168 also is attached to a skirt 178, the valance 176 is located on the outer side of the skirt 178. The valance 176 may be continuous as a single piece, or present in sections between the struts 90, 92. Valances are commonly included on umbrella canopies and are obvious design choices to any person having ordinary skill in the art. Where a skirt 178 is attached to the canopy 168, the valance 176 provides an aesthetic benefit of obscuring the skirt 178 when it is in the retracted position.

As exemplified in FIG. 14, the umbrella described herein has several advantages when used in conjunction with a table having a central hole transecting its top, allowing for the umbrella pole 108 pass freely through the table top. For pedestal-style tables, the hole should extend through the length of the pedestal, in which case an appropriately shaped umbrella base should be employed. Alternately, a table pedestal may function as the umbrella base 102. The relative size and shape of the canopy 168 and table top should be such that the canopy 168 extends beyond the outer perimeter of the table. More preferably, the canopy 168 size and shape extends beyond the outer perimeter of the table as well as any chairs that may be situated around the table.

The canopy 168 is supported by a series of substantially evenly spaced struts 90, 92 radiating outward from the center of the frame near the pole 108, and terminating near the outer edges of the canopy168, as previously described. Basic strut design is well-known and commonly understood by any person having ordinary skill in the art. FIGS. 1, 4, 7, and 12 show two representative struts, it being understood that one or more additional struts would be required, and that the embodiments depicted in those figures requires six additional struts in the same configuration as those representatively shown in the respective Figures.

The struts 90, 92 may be straight, or they may include a delicate convex arch. The number of struts 90, 92 may vary depending on the size and shape of the canopy 168. It will be appreciated by any person having ordinary skill in the art that the size, shape, and material making up the canopy 168 will affect the optimal number of struts 90, 92 required to effectively support the canopy 168 and maintain it taut. The framework should have at least three struts 90, 92, and preferably four or more struts 90, 92. In a preferred embodiment, the framework will include six or more struts 90, 92. Large canopies may require eight or more struts 90, 92. In determining the optimal number of struts 90, 92, it is preferable to employ the lowest number of struts 90, 92 that perform the function satisfactorily, in order to minimize the overall weight of the frame. Selection of the material from which the struts 90, 92 are made is well within the skill of the art, and typically includes concern for strength and durability. Commonly used materials include, but are not limited to, steel, aluminum, wood, plastic, and resin.

In a preferred embodiment, the struts 90, 92 comprise a long upper strut arm 162, 262 pivotably connected to a short lower strut arm 160, 260. The upper 162, 262 and lower 160, 260 strut arms may be connected adjacent to one another with a pivot connector 164, or they may be connected centrally with a pivot connector 264 so that they are in alignment, in which case the lower strut arm 260 is connected to the underside of the upper strut arm 262. The pivot connection 164, 264 extends through both upper 162, 262 and lower 160, 260 strut arms, providing an axle about which the upper 162, 262 and lower 160, 260 strut arms rotate.

Each upper strut arm 162, 262 extends from its terminus at the outer edge of the canopy 168, slightly upward toward the center of the framework at the pole 108, terminating at a pivot connection 166 with the upper canopy support 148, 248, 348. The lower strut arm 160, 260 terminates at the pivot connection 164, 264 with the upper strut arm 162, 262, extends slightly downward toward the center of the framework at the pole 108, and terminates at a pivot connection 166 with the lower canopy support 140, 240, 340. Thus, when the canopy 168 is fully extended, the area bounded by the upper strut arm 162, 262, the lower strut arm 160, 260, the pole 108, the upper canopy support 148, 248, 348, and lower canopy support 140, 240, 340 forms a triangular shape.

In order to collapse the canopy 168, the lower canopy support 140, 240, 340 must be moved downward, off the sliding sleeve 136, and away from the upper canopy support 148, 248, 348. In so doing, the acute angle formed at the pivot connection 164, 264 of the upper 162, 262 and lower 160, 260 strut arms becomes increasingly larger, nearing 180° when the canopy 168 is fully collapsed. In this position, the upper 162, 262 and lower 160, 260 strut arms are substantially vertical and parallel to the pole 108.

Placement of the pivot connection 164, 264 for optimal performance of the strut 90, 92 is well within the skill of the art, and may occur anywhere along the length of the upper strut arm 162, 262. Preferably the pivot connection 164, 264 is at a point less than half the length of the upper strut arm 162, 262, and more preferably at a point less than one third the length of the upper strut arm 162, 262.

Central to the framework is a hollow pole 108 of appropriate proportions and strength to support the rest of the frame and the canopy 168, as well as any optional components such as a skirt 178, vent flap 172, and/or valance 176.

Preferably, the pole 108 is cylindrical. The pole 108 has a bottom portion having a bottom end that preferably may be permanently mounted, planted into the ground, or inserted into a standard base 102. The elongated middle portion of the pole 108 extends upward, optimally through the center of a table, transecting the table top.

The length of the pole 108 should be sufficiently long such that when the canopy 168 is fully extended, adult persons may freely walk upright beneath the canopy 168 and any valance 176. Moreover, the pole 108 should be of sufficient length such that the lower strut arms 160, 260 are not in the direct field of vision of persons seated at the table when the canopy 168 is fully extended. The pole 108 should be of sufficient length such that the canopy 168 may be fully collapsed without the outer termini of the upper strut arms 162, 262, or the periphery of the canopy 168, coming into contact with the table top. Also, the pole 108 should be of sufficient length such that the lower canopy support 140, 240, 340 has sufficient room to move downward along the pole 108 until the canopy 168 is fully collapsed.

The top portion of the pole 108 has at least one pulley opening 182 in its cylindrical wall for mounting a fixed (Class 1) pulley 184 with a pulley mount 188 and allowing a cable 180 to run from the upper canopy support 148, 248, 348, over the top of the pulley 184 toward the internal hollow portion of the pole 108, and down the other side of the pulley 184 into the inside of the pole 108. The pulley opening 182 is located at a height above the sliding rail 114 and the highest reachable point of the upper canopy support 148, 248, 348, and may be disposed to either side of the sliding rail 114 or directly above it so long as the cable 180 does not contact the sliding rail 114. The pulley 184 may be mounted in any reasonable manner, for example, the pulley mount 188 is a nut and bolt combination. Where more than one cable 180 and pulley 184 pair is utilized, the pulley openings 182 in the side wall of the pole 108 should be staggered in height, and situated on the wall of the pole 108 in parallel, such that the pulleys 184 and cables 180 do not interfere with one another. Preferably, the cables 180 should enter the internal portion of the pole 108 from opposing sides. For large and/or heavy canopies and/or frames, multiple pulleys 184 may be required in order to provide balance to the system, as shown in FIG. 13 (not to scale)

Preferably, the pulley 184 should include a guard 186 to ensure that the cable 180 does not become disengaged with the pulley 184, for example, during shipment. Pulley guards are readily apparent to any person having ordinary skill in the art and include, for example, fender guards, closed casing covers, and u-strips.

Figure 4:
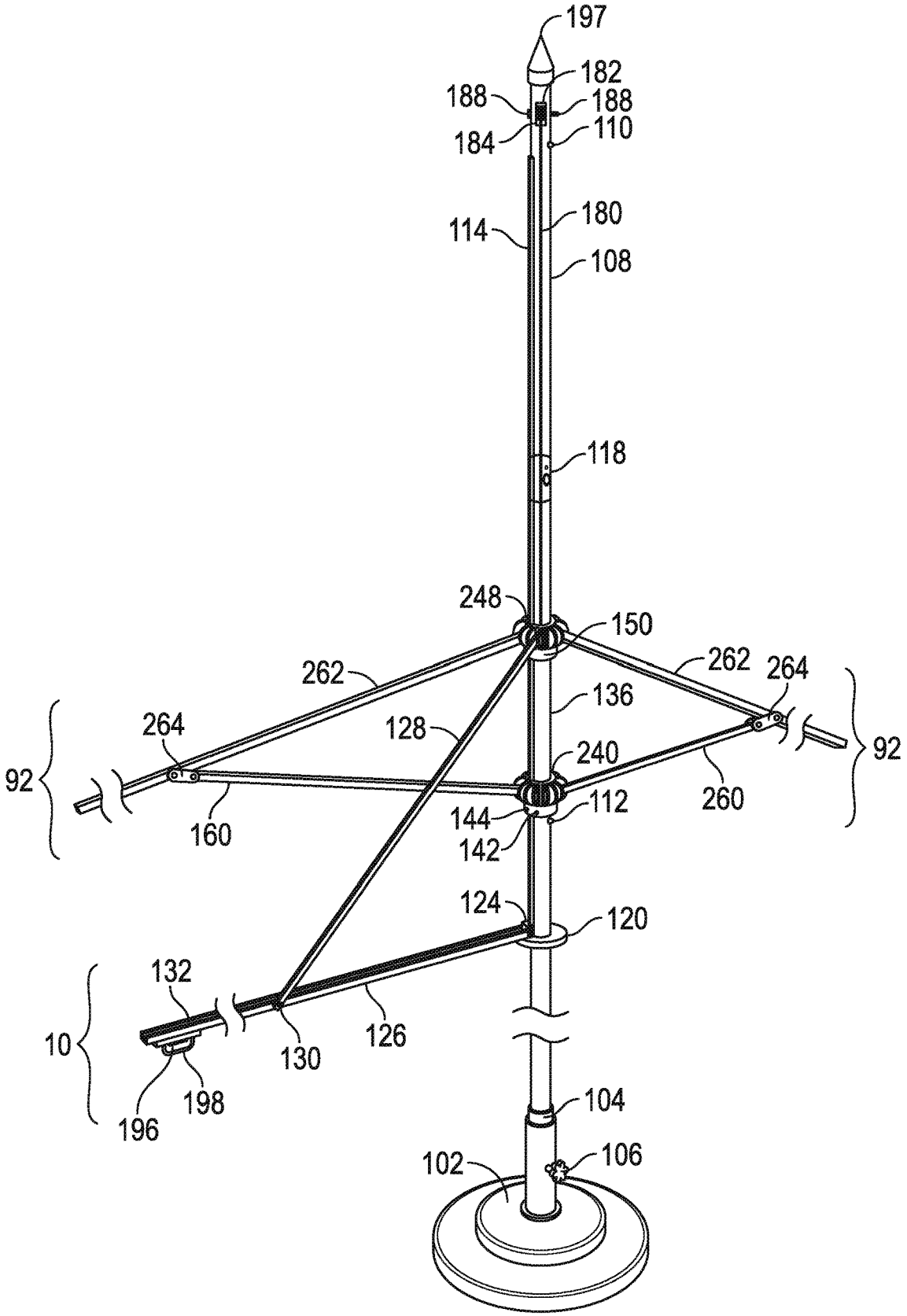
FIG. 4 shows an alternative embodiment of the major components of the umbrella frame including the actuator, two representative struts, sliding sleeve, pole, sliding rail, upper and lower canopy supports, and pulley mechanism, wherein the actuator arms are offset at their pivot connection and the strut arms are aligned at their pivot connections.
Figure 7:
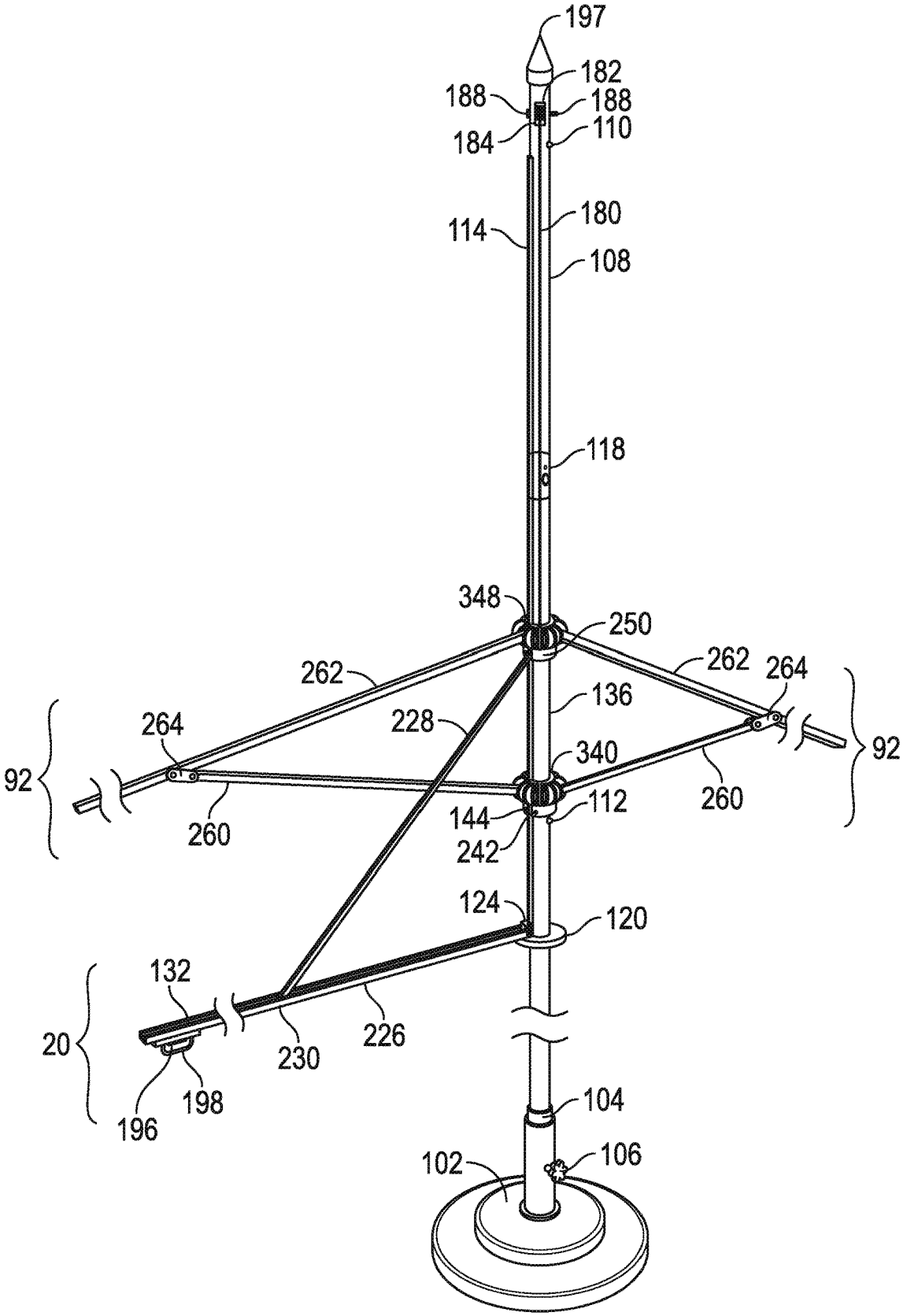
FIG. 7 shows an alternative and preferred embodiment of the major components of the umbrella frame including the actuator, two representative struts, sliding sleeve, pole, sliding rail, upper and lower canopy supports, and pulley mechanism, wherein the actuator arms and strut arms are aligned at their pivot connections.

The pulley cable(s) 180 may be constructed from material appropriate for its purpose, considering factors such as strength and durability. Rope and steel are commonly used, with steel cable being preferable. The pulley cable(s) 180 should extend substantially vertically from the top of the upper canopy support 148, 248, 348 upward to its corresponding pulley(s) 184, as shown in FIGS. 1, 4 and 7. In a simple form of connection to the upper canopy support 148, 248, 348, for example, a pulley cable 180 extends from the top of the upper canopy support 148, 248, 348 downward through a hole (not shown) having its exit between two stay pairs 30-38, 50-58, 70-77, where the end of the cable 180 is fixed with a crimp (not shown). In an alternate embodiment, the hole in the upper canopy support 148, 248, 348 (not shown) for accepting the cable 180 may be placed closer to the inner edge of the upper canopy support 148, 248, 348, extending from the top of the upper canopy support 148, 248, 348 downward through the neck 150, 250 of the upper canopy support 148, 248, 348 to the underside of the upper canopy support 148, 248, 348, where the cable 180 is permanently connected by any reasonable means, including, but not limited to a crimp (not shown).

Figure 13:
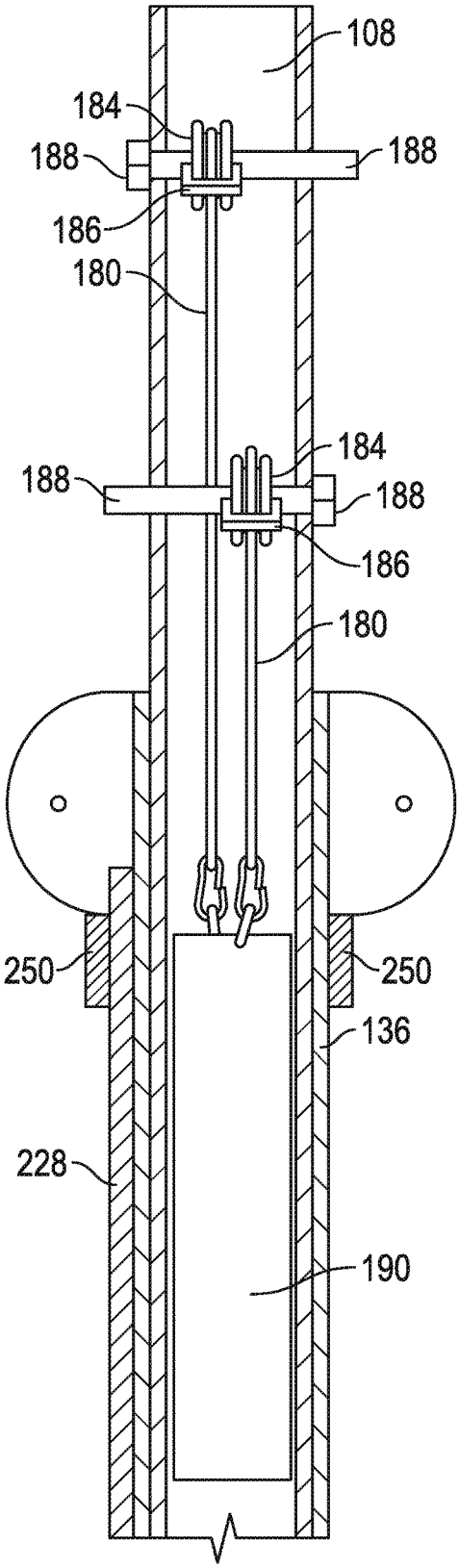
FIG. 13 shows major internal components of the umbrella frame located partially or wholly inside the pole, including the pulley mount and mechanism, and the counterbalancing weight (not to scale).

As shown in FIG. 13 (not to scale) the cable 180 extends vertically downward from the top of the pulley 184 through the void in the pole 108 and is connected to a single weight 190 configured to easily move up and down inside the pole 108. Where more than one pulley 184 and cable 180 pair is utilized, they should operate without interfering with one another. Therefore, multiple cables 180 should extend from different points on the top of the upper canopy support 148, 248, 348, over their respective pulleys 184, and downward though the hollow of the pole 108 to be attached to the single weight 190. The cables 180 may be connected to the weight 190 by any reasonable means, for example, with an eye bolt. The weight 190 attached to the cable(s) 180 is substantially equal to the combined weight of the canopy 168, struts 90, 92, upper and lower canopy support 140, 240, 340, sliding sleeve 136, vent flap 172 (if any), valance 176 (if any), skirt 178 (if any), and optional ballast weights 192.

The weight 190 located internally in the pole 108 is intended to counterbalance the combined weight of the components that are raised and lowered by the actuator 10, 20. The combined weight of the components may be variable, however. For example, a wet canopy 168 may weigh more than a dry canopy 168. Different skirt 178 attachments may weigh more or less than one another. Dirt and dust may build up on the pulleys 184 over time, or wear on the pulley(s) 184 and/or cable(s) 180 may increase friction, requiring adjustment of the counterbalanced weight in order to maintain ease of operation of the actuator 10, 20. An optional set of ballast weights 192 may be included to make adjustments to the combined weight of the components to be raised and lowered by the actuator 10, 20 such that it remains substantially counterbalanced with the weight 190 inside the pole 108.

Figure 12:
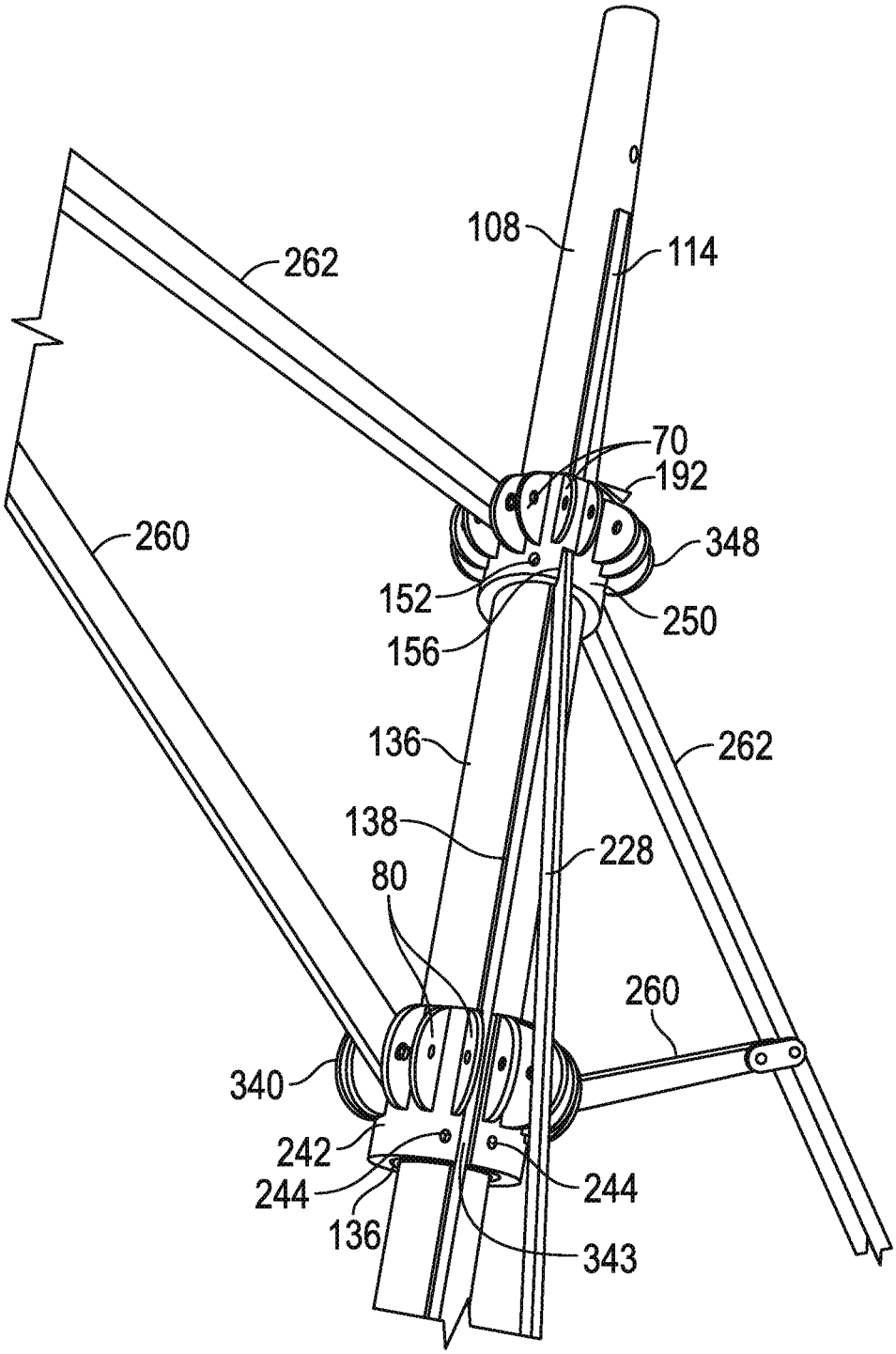
FIG. 12 shows detail of the umbrella pole, sliding rail, sliding sleeve, upper and lower canopy supports configured for pivotably attaching the struts and actuator corresponding to the frame design in FIG. 7, two representative struts pivotably connected between stays in the upper and lower canopy supports, the upper actuator arm pivotably connected in the upper canopy support neck groove, lower canopy support channel exposing the sliding rail, and the upper and lower canopy support connectors for attachment to the sliding sleeve.

The ballast weights 192 may be attached by any reasonable means to any of the other components making up the combined counterbalanced weight, so long as they do not interfere with any of the intended functions of those components. Preferably, the ballast weights 192 are located on the upper canopy support 148, 248, 348, and more preferably on or near the top of the upper canopy support 148, 248, 348 as shown in FIG. 12.

The optimized actuator 10, 20 working in conjunction with the counterbalanced weight system provides an elegant and simple design requiring very little effort to operate, regardless of the size and weight of the canopy 168 and supporting framework.

The uppermost end of the pole 108 should be fitted with a cap in the case where the pole 108 terminates on the underside of the canopy 168. Where the pole 108 extends through a canopy hole 170, the uppermost end of the pole 108 may be fitted with a decorative finial. The cap or finial 197 prevents moisture, dirt, dust, and debris from entering the inner portion pole 108 and prevents exposure of sharp edges, as well as adding a decorative feature. These features are well-known within the state of the art.

Figure 19:
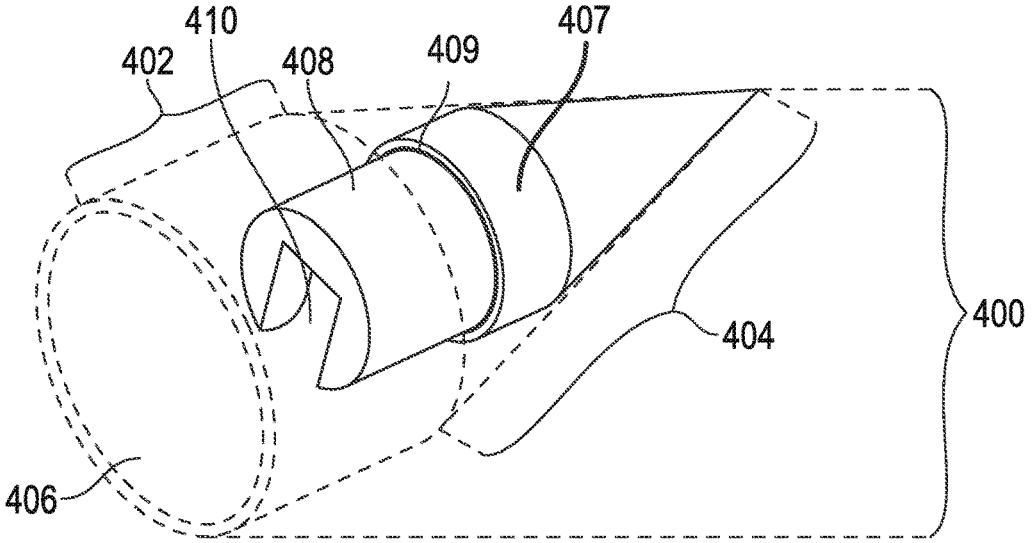
FIG. 19 shows an alternate embodiment of a finial, specifically, the outer top and the inner stabilizer of a stabilizing finial (not to scale).
Figure 20:
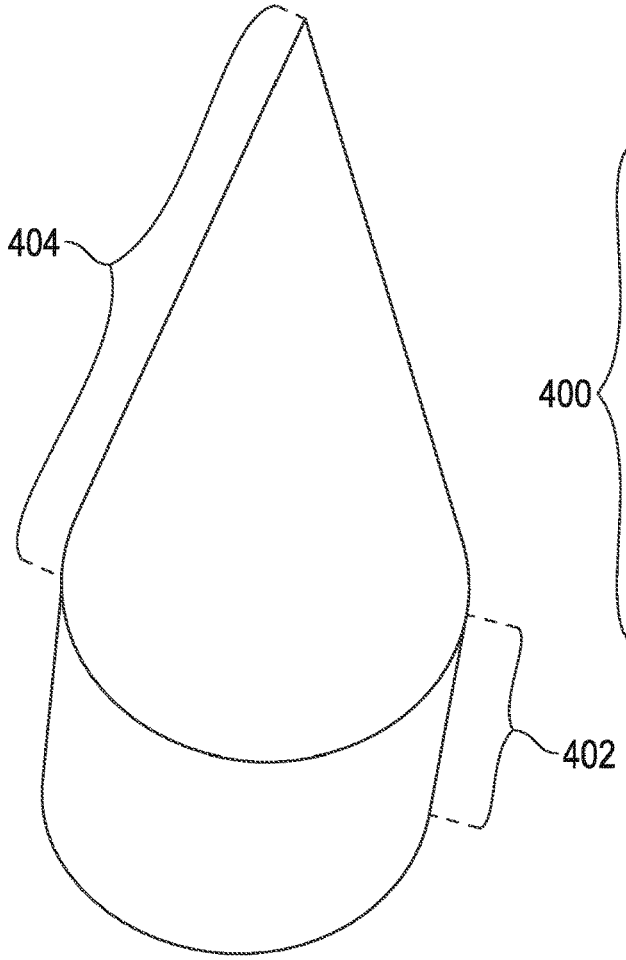
FIG. 20 shows the outer view of the stabilizing finial in FIG. 19 (not to scale).
Figure 21:
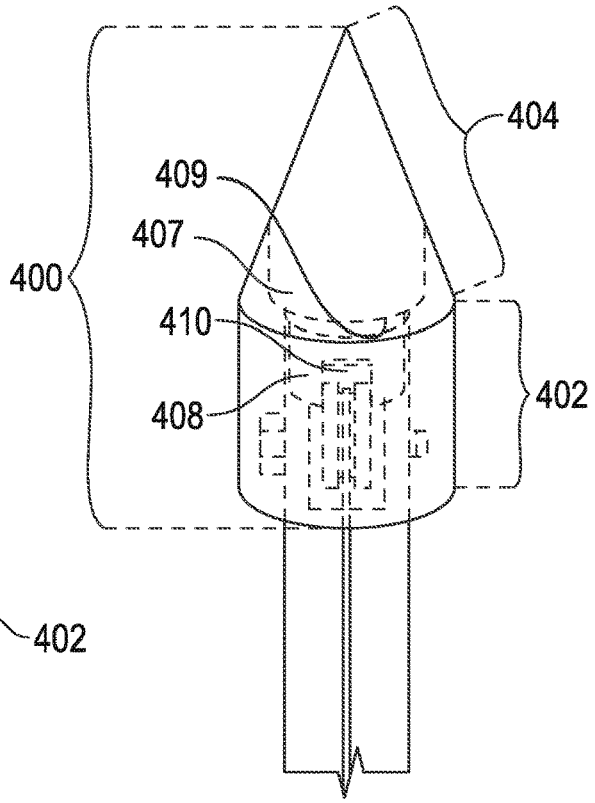
FIG. 21 shows the configuration of the stabilizing finial in FIGS. 19 and 20 configured such that a stabilizer base fits over the pole shown in FIGS. 1, 4, 7, 11, 12, 13, 14, 16, 17, and 18, and also such that a stabilizer canal fits over the pulley shown in FIGS. 1, 4, 7, 13, and 14 (not to scale).

FIGS. 19, 20, and 21 show an alternate embodiment of a stabilizing finial 400 having a stabilizing finial base 402 and a stabilizing finial top 404. The stabilizing finial top 404 extends from its inner, upper portion downward to form a stabilizing finial plug 407 having substantially the same shape and size as the pole 108. The stabilizing finial plug 407 extends further downward to form a stabilizer 408, having a slightly smaller perimeter than the stabilizing finial plug 407, so as to enable insertion of the stabilizer 408 into the pole 108. The interface of the smaller stabilizer 408 and the larger stabilizing finial plug 407 forms a sealing edge 409 that abuts the top of the pole 108. The bottom portion and one side of the asymmetrical stabilizer 408 include a stabilizer canal 410 having substantially the same shape as the upper portion of a pulley 184, such that when the stabilizing finial 400 is attached to the pole 108, the stabilizing finial plug 407 rests atop the pole 108 at the sealing edge 409, the stabilizer 408 is inserted into the inner portion of the pole 108, and the stabilizer canal 410 fits over and around the upper portion of the uppermost pulley 184. The remainder of the inner portions of the stabilizing finial base 402, and stabilizing finial top 404 are recesses around the stabilizing finial plug 407, stabilizer 408, and sealing edge 409. Thus, when the stabilizing finial 400 is inserted into the pole 108, the stabilizing finial base 402 extends downward along the outer portion of the pole 108.

When the stabilizing finial is inserted into the pole 108, the stabilizer 408 and stabilizer canal 410 maintains the cable 180 on the uppermost pulley 184, thus eliminating the need for a pulley guard 186, and serves to keep the pulley 184 stabilized. The finial plug 407 and sealing edge 409 prevent debris and moisture from entering the inner portion of the pole 108.

FIGS. 19, 20, and 21 (not to scale) show an embodiment of the stabilizing finial 400 in which the stabilizer canal 410 is centrally, albeit asymmetrically configured in the stabilizer 408 for use with a single-pulley configuration. In the case of a multiple-pulley system, the stabilizer canal 410 would be offset to one side of the asymmetrically configured stabilizer 408 to accommodate the adjacently situated pulleys 184.

Figure 22:
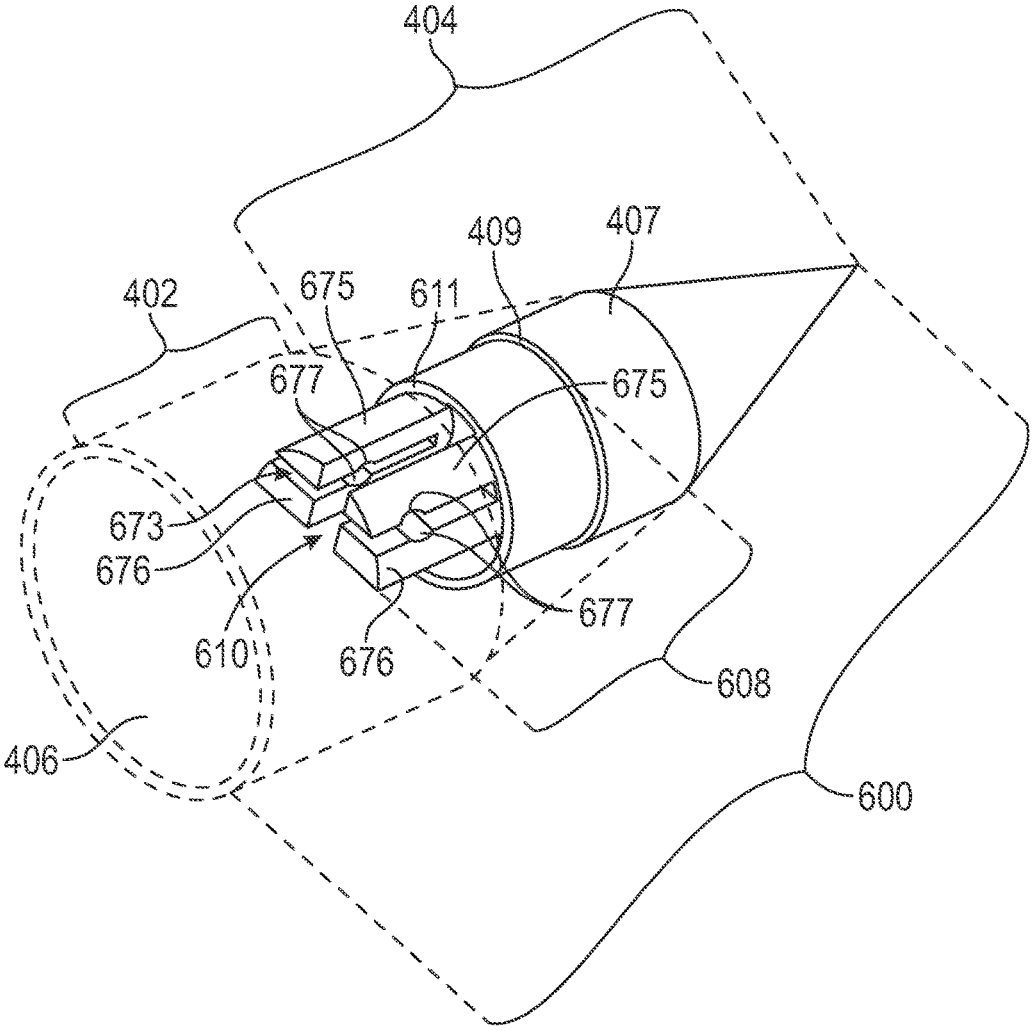
FIG. 22 shows an alternate embodiment of a stabilizing finial, specifically, having a stabilizer slot perpendicular to the stabilizer canal, the intersection of which forms two pairs of flexible stabilizer legs, each stabilizer leg having a stabilizer leg groove.
Figure 23:
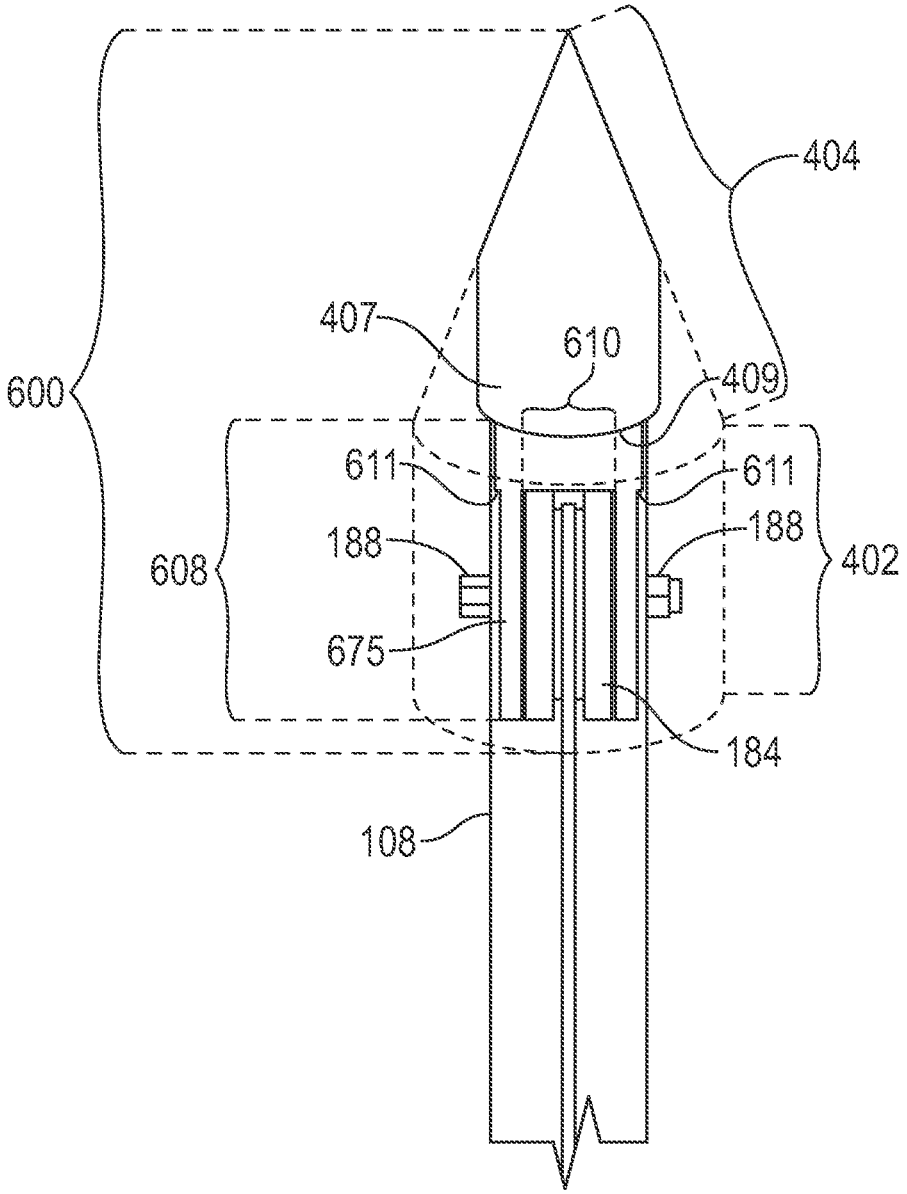
FIG. 23 shows the configuration of the stabilizing finial in FIG. 22 (not to scale) configured such that a stabilizer canal fits over the pulley shown in FIGS. 1, 4, 7, 13, and 14, and the stabilizer slot fits over the pulley mount shown in FIGS. 1, 4, 7, 13, and 14, and wherein the stabilizer leg notches snap into place around the pulley mount.

FIGS. 22 and 23 (not to scale) show an alternate embodiment of a stabilizing finial 600 having a modified stabilizer 608 in which the stabilizer canal 610 extends fully across the stabilizer 608. The stabilizer canal 610 fits over and around the upper portion of the uppermost pulley 184. For example, in a single pulley configuration, the stabilizer canal 610 may be situated substantially centrally in the stabilizer 608. In a multi-pulley configuration having the pulleys offset in parallel from one another, as previously described, the stabilizer canal 610 may be offset to fit over the uppermost pulley 184. A stabilizer slot 673 runs perpendicular to and intersects the stabilizer canal 610, forming two pairs of flexible stabilizer legs 675, 676. Each pair of stabilizer legs 675, 676 is symmetrically opposed to one another. The stabilizer slot 673 is positioned in the stabilizer 608 so that it extends into the pole 108, and down past the uppermost pulley mount 188 to fit securely around it, with a pair of symmetrical stabilizer legs 675, 676 situated on either side. Because the pulley 184 extends through the pulley opening 182, the pulley mount 188 and the stabilizer slot 673 are typically offset from center in the stabilizer 608. Each pair of stabilizer legs 675, 676 have opposing stabilizer leg grooves 677. The stabilizer leg grooves 677 snap into place around the uppermost pulley mount 188. The stabilizer legs 675, 676 are slightly inset and the total circumference of the stabilizer legs 675, 676 taken together is smaller than the top portion of the stabilizer 608, thereby forming a stabilizer ridge 611 on the underside of the cylindrical upper portion of the stabilizer 608 where the stabilizer legs 675, 676, the stabilizer slot 673, and the stabilizer canal 610 are adjacent. This is so that the stabilizer legs 675, 676 can flex outward when being snapped into place around the pulley mount 188, and avoid being vertically flush against the inner side of the pole 108.

A sliding rail 114 runs vertically along the length of the pole 108, from its connection to the lower actuator arm support 120 at about the top of the bottom portion of the pole 108 to the top of the upper canopy support 148, 248, 348 when the canopy 168 is in the raised position, as seen in FIGS. 1, 4, 7, 11, 12, and 14. The top of the sliding rail 114 is located at about the bottom of the top portion of the pole 108, and the bottom of the sliding rail 114 and lower actuator arm support 120 are located at about the top of the bottom portion of the pole 108. The sliding rail 114 bears a notch 116 for accepting the pivotable connector joining the upper 128, 228 and lower 126, 226 actuator arms, when the actuator 10, 20 is in the raised position, as more fully described herein. The notch 116 should be appropriate to allow the upper actuator arm 228 to rest flush against the sliding rail 114 when the actuator 10, 20 is in the raised position, but it should not interfere with the mobility of the sliding sleeve 136. The sliding rail 114 guides the sliding sleeve 136 when it is raised and lowered via operation of the actuator 10, 20, and stabilizes the upper 148, 248, 348 and lower 140, 240, 340 canopy supports, preventing them from turning about the pole 108.

The pole 108 and sliding rail 114 optionally may include a tilting mechanism 118 for arranging the canopy 168 at different angles and positions relative to the ground. Various tilting mechanisms 118 are common in the art and include, for example, knuckle tilts. The tilting mechanism 118 should form a smooth interface with the pole 108 and sliding rail 114 when not employed, enabling the sliding sleeve 136 to pass over it freely. The tilting mechanism 118 should be located below the lower canopy support 140, 240, 340 when the canopy is in the raised position, as shown in FIG. 14.

The pole 108 may include an upper stop tab 110 and a lower stop tab 112, as shown in FIG. 1. The upper stop tab 110 is located below the lowest pulley 184, and prevents the upper canopy support 148, 248, 348 from coming into contact with it. The lower stop tab 112 is located at the bottom of the lower canopy support 140, 240, 340 when the actuator 10, 20 is in the lowered position, and acts to prevent harm to the lower actuator arm 126, 226 from a pivot of greater than 90 degrees relative to the pole 108.

The framework includes an actuator 10, 20 for raising and lowering the canopy 168 while it is in the extended position. The actuator 10, 20 comprises a lower actuator arm 126, 226 joined to an upper actuator arm 128, 228 by a pivot connection 130, 230 extending through both actuator arms 126, 128; 226, 228. The pivot connection forms an axle about which the actuator arms 126, 128; 226, 228 rotate. The upper 128 and lower 126 actuator arms may be pivotably connected adjacent to one another, or the upper 228 and lower 226 actuator arms may be pivotably connected centrally so that they are in alignment, in which case the upper actuator arm 228 is connected to the top side of the lower actuator arm 226, in the lower actuator arm channel 132, as shown in FIG. 7.

Figure 10:
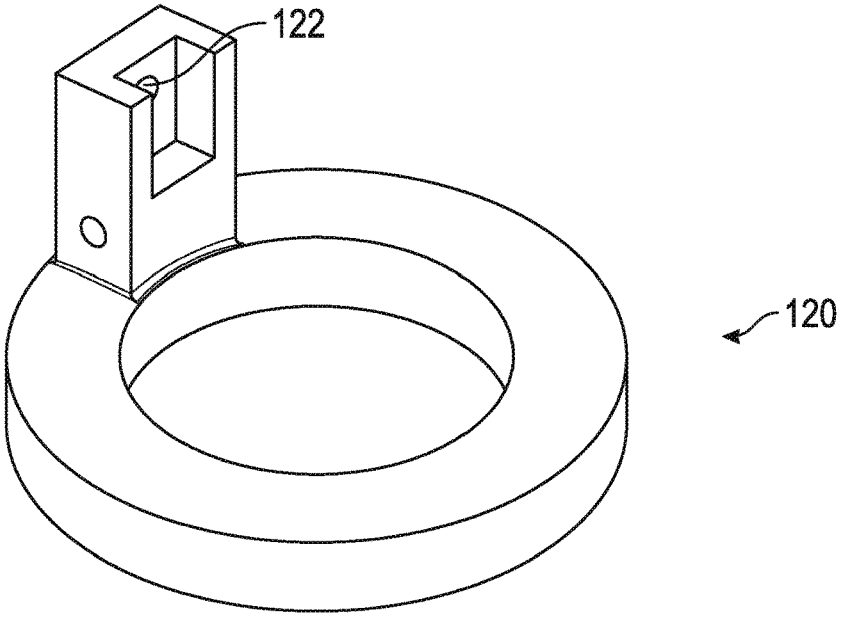
FIG. 10 shows the lower actuator arm support and holes for the lower actuator arm support mount and for the lower actuator arm support connector.
Figure 11:
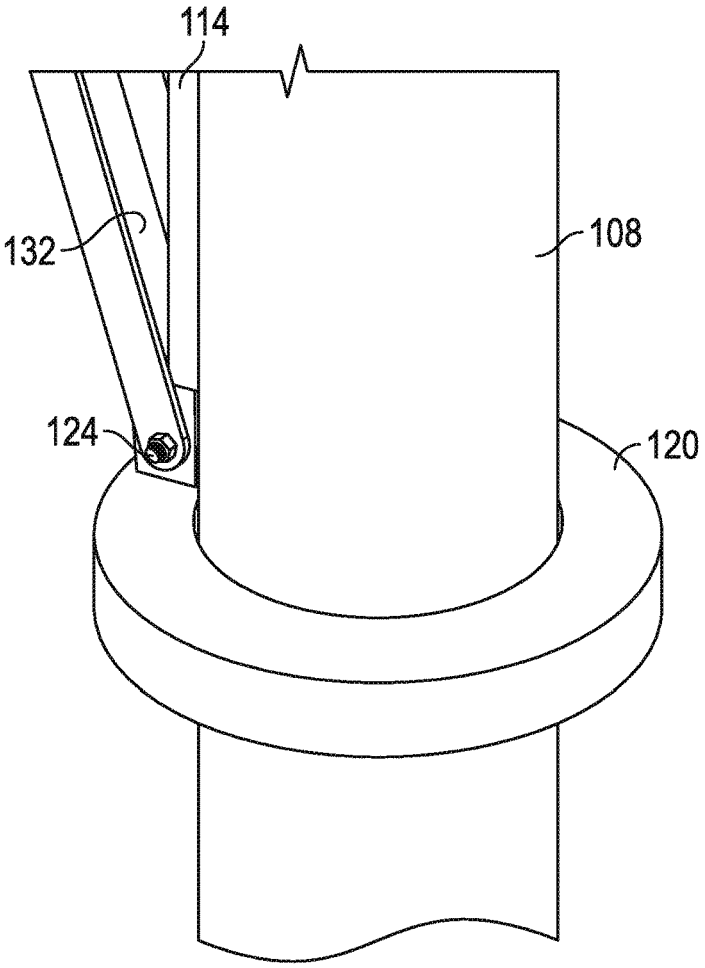
FIG. 11 shows the lower actuator arm support in FIG. 10 mounted onto the sliding rail of the umbrella pole and having the lower actuator arm pivotably connected thereto.

As shown in FIGS. 1, 4, and 7 and in greater detail in FIGS. 10 and 11, the lower actuator arm 126, 226 is pivotably connected to a lower actuator arm support 120 mounted to the sliding rail 114 by a fixed connection 124, such as a bolt extending through the lower actuator arm support mounting hole 122 and sliding rail 114, and optionally, also through the adjacent wall of the pole 108. The lower actuator arm support connector 124 is a pivot connection extending through the lower actuator arm 126, 226 to provide an axle about which the lower actuator arm 126, 226 rotates. The lower actuator arm support 120 is mounted to the sliding rail 114 at a position that is above the top surface of the table through which the pole 108 passes, such that when the lower actuator arm 126, 226 is in the lowered position, it extends outward from the pole 108 substantially at a 90° angle a short distance above the table. The lower actuator arm 126, 226 extends outward and is of sufficient length to enable its operation without the operator becoming encumbered by the canopy 168 as it is lowered. The upper actuator arm 128, 228 terminates at one end at the pivot connection 130, 230 with the lower actuator arm 126, 226, and extends to the upper canopy support 148, 248, 348. The upper actuator arm 128, 228 may be pivotably attached to the upper canopy support 148, 248, 348, for example, between a pair of stays 38, 58. More preferably, the upper actuator arm 128, 228 is pivotably attached to the upper canopy support 148, 248, 348 at the neck 150, 250 or bottom of the support. Additionally, the end of the upper actuator arm 128, 228 and the pivot connection (not visible) may be recessed into a groove 156 in the wall of the neck and/or bottom of the upper canopy support 148, 248, 348. The pivot connection extends through the upper actuator arm 128, 228, providing an axle about which it rotates. Thus, when the actuator 10, 20 is fully lowered, the area bounded by the upper actuator arm 128, 228, the lower actuator arm 126, 226, the pole 108, and the upper canopy support 148, 248, 349 forms a substantially triangular shape.

Figure 15:
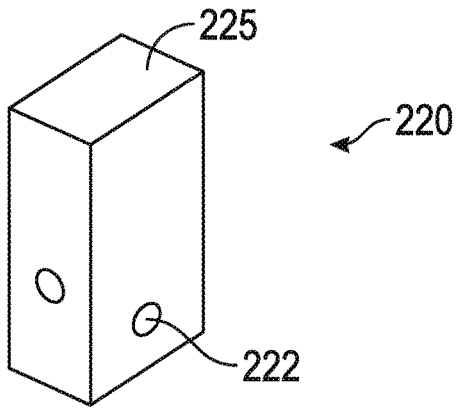
FIG. 15 shows an alternate embodiment of a lower actuator arm support.
Figure 16:
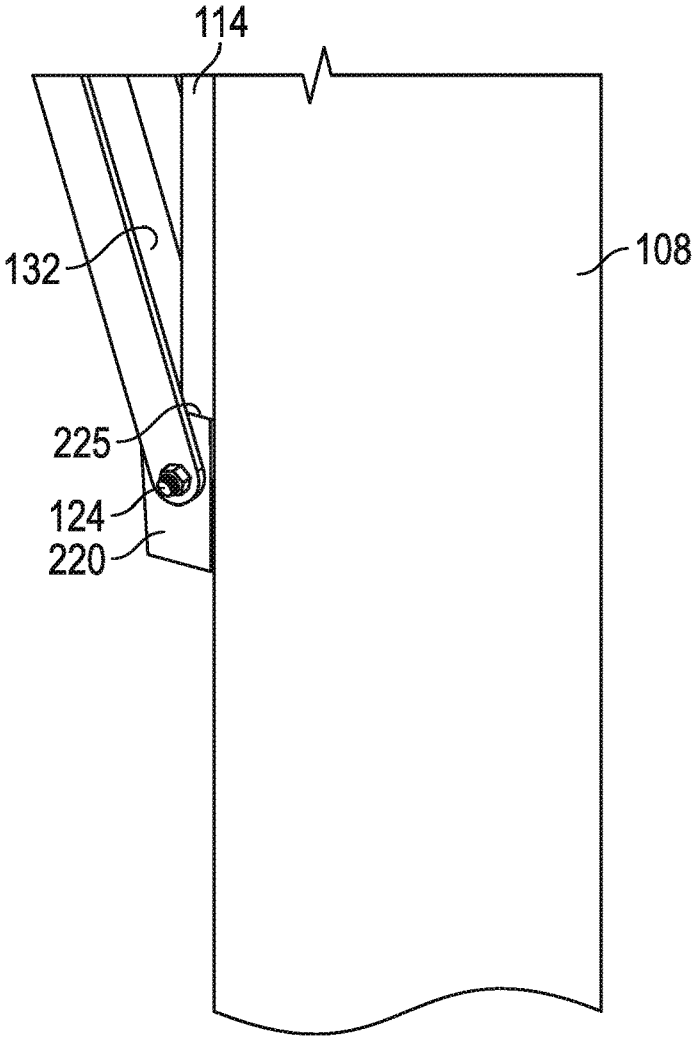
FIG. 16 shows an alternative embodiment of the lower actuator arm support in FIG. 15 connected to a pivotable lower actuator arm, pole, and sliding rail.

FIGS. 15 and 16 show alternate embodiments of the lower actuator arm support 220. The lower actuator arm support 220 may be connected directly to the pole 108, for example, by welding. This embodiment eliminates the need for the collar portion of the support around the pole 108. The lower actuator arm support 220 may be mounted to the sliding rail 114 at a position that is above the top surface of the table through which the pole 108 passes, such that when the lower actuator arm 126, 226 is in the lowered position, it extends outward from the pole 108 substantially at a 90° angle a short distance above the table. Alternatively, the lower actuator arm support 220 may be configured as a solid block having an optional support mounting hole 222 for accepting an optional fixed connector, such as a bolt extending through the lower actuator arm support mounting hole 222 and pole 108. When configured as a single block, the lower actuator arm support 220 is situated at the terminal bottom portion of the sliding rail 114 at interface 225. The sliding rail 114 may be shorter in length when the lower actuator arm support 220 is configured as a block, in which case the sliding rail 114 is not situated in the recess of the lower actuator arm support adjacent to the pole 108. Alternatively, the lower actuator arm 220 block configuration may be situated lower on the pole 108, provided that when the lower actuator arm 126, 226 is in the lowered position, it extends outward from the pole 108 substantially at a 90° angle a short distance above the table. Lower actuator arm support 220 includes a hole for accepting a lower actuator arm support connector 124.

Proper determination of the relative lengths of the upper 128, 228 and lower 126, 226 actuator arms and placement of the actuator arm pivot connection 130, 230 is important to the overall design. These factors impact the overall ease of operation and the amount of force required by the operator to move the actuator 10, 20. Optimal placement of the pivot connection 130, 230 is capable of resulting in less than one pound of pressure required to move the canopy 168 using the actuator 10, 20.

Figure 24:
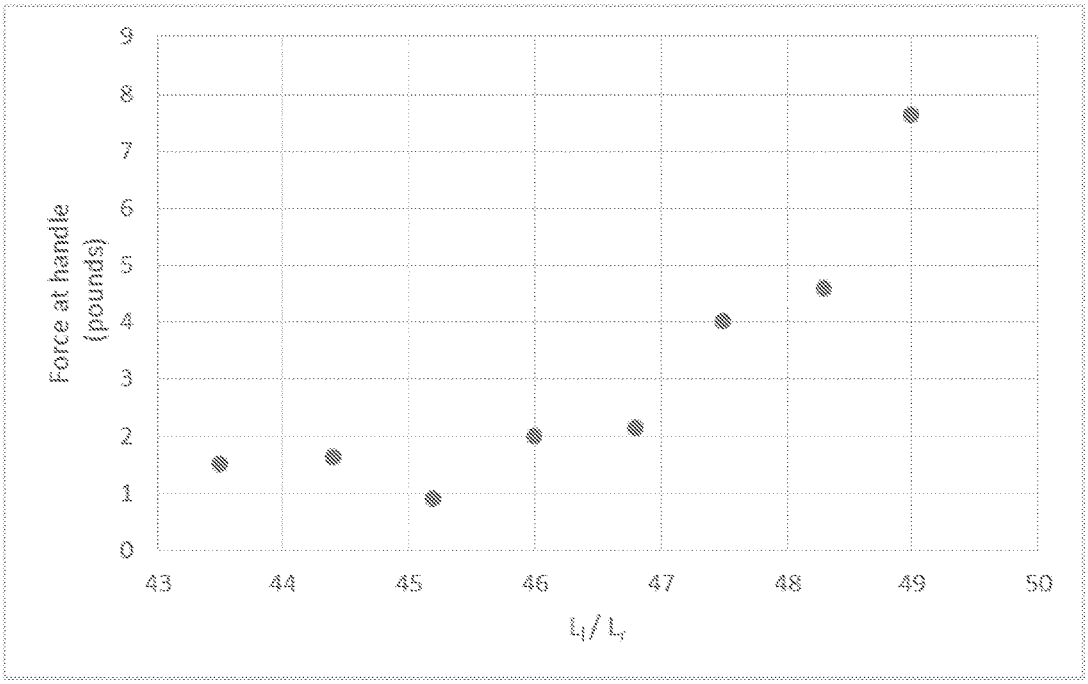
FIG. 24 is a graph showing the relationship between pressure required to operate the actuator and relative ratios of lower actuator arm length $L_l$ to total actuator arm length $L_r$.

As discussed herein, when the actuator 10, 20 is in the raised position, the portion of the lower actuator arm 126 extending outward past the pivot connection 130 overlaps with the upper actuator arm 128 when adjacently connected. Likewise, when the actuator 10, 20 is in the raised position, the portion of the portion of the lower actuator arm 226 extending outward past the pivot connection 230 folds over the upper actuator arm 228 when centrally connected, whereby the upper actuator arm 228 fits into the lower actuator arm channel 132. Therefore, the total length of the actuator 10, 20 in the raised position ($L_r$) is the sum of the lengths of the lower actuator arm 126, 226 measured from the pivot connection 130, 230 to the lower actuator arm support connection 124 ($L_l$), and the upper actuator arm 128, 228 measured from the pivot connection 130, 230 to its connection with the upper canopy support 148, 248, 348 ($L_u$). Therefore, $L_r=L_l+L_u$. Adjusting the relative $L_l$ and $L_u$ ratio affects the amount of pressure required to operate the actuator 10,20. As shown in FIG. 24, it is preferable for $L_l$ to be about 43-47% of $L_r$, and more preferably about 44-46% of $L_r$, and even more preferably about 45% of $L_r$.

As the actuator 10, 20 is raised, the angle formed at the pivot connection 130, 230 of the upper 128, 228 and lower 126, 226 actuator arms becomes increasingly large, nearing 180° when the actuator 10, 20 is fully raised. In this position, the actuator arms 126, 128; 226, 228 are substantially vertical and parallel to the pole 108.

Figure 3:
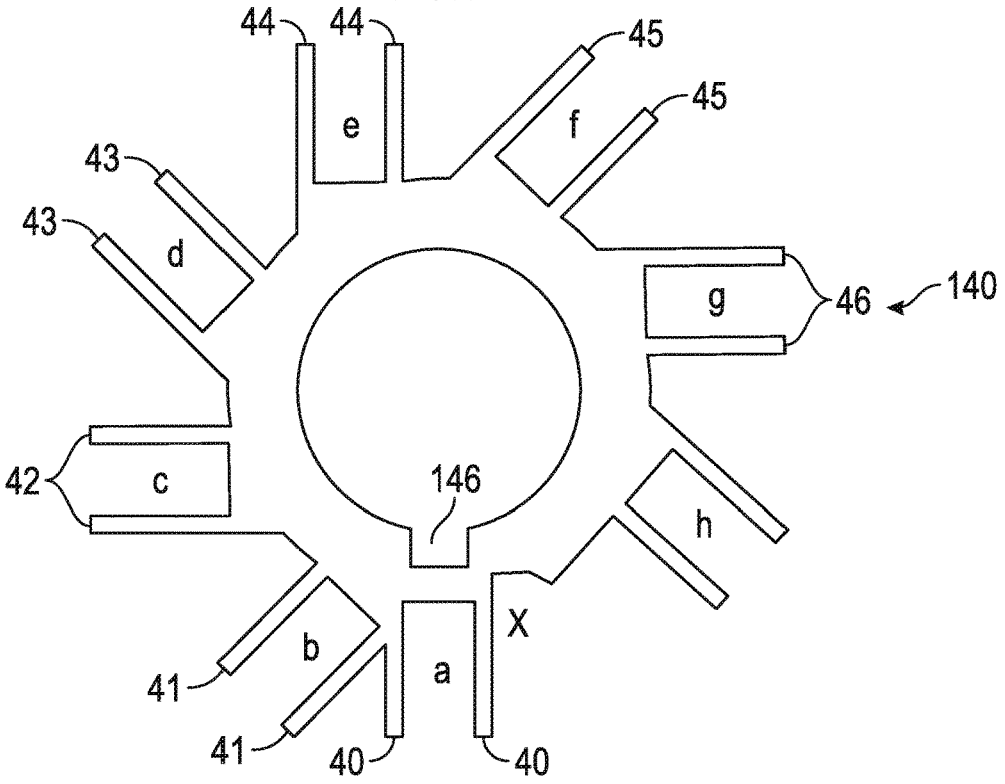
FIG. 3 shows a lower canopy support having pairs of stays configured for pivotably attaching the struts and actuator corresponding to the frame design in FIG. 1.
Figure 6:
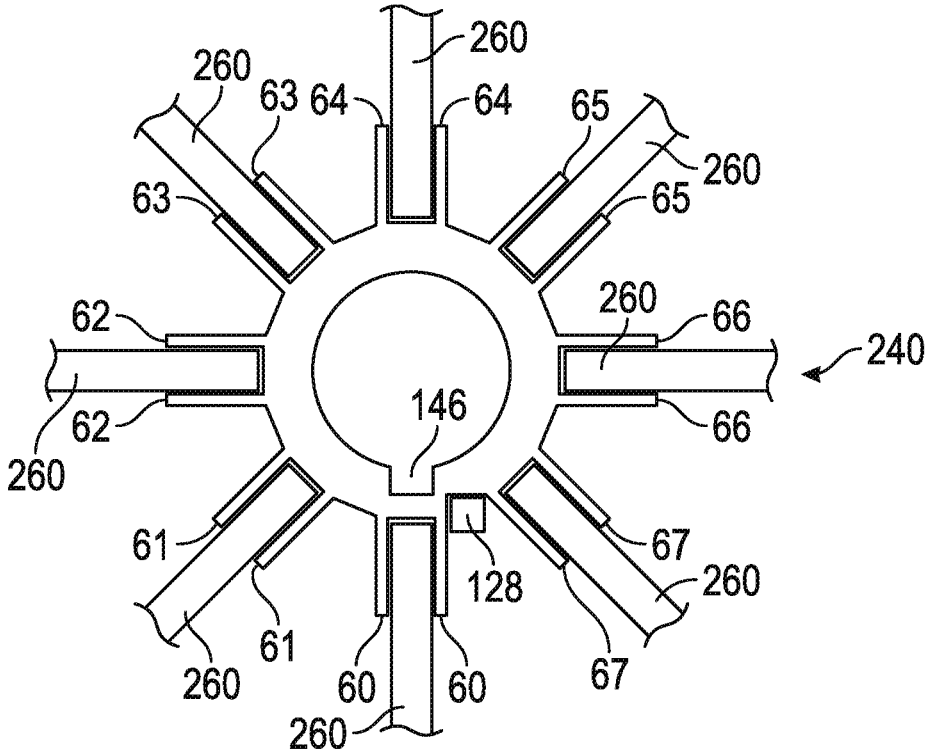
FIG. 6 shows a lower canopy support having pairs of stays configured for pivotably attaching the struts and actuator corresponding to the frame design in FIG. 4.
Figure 9:
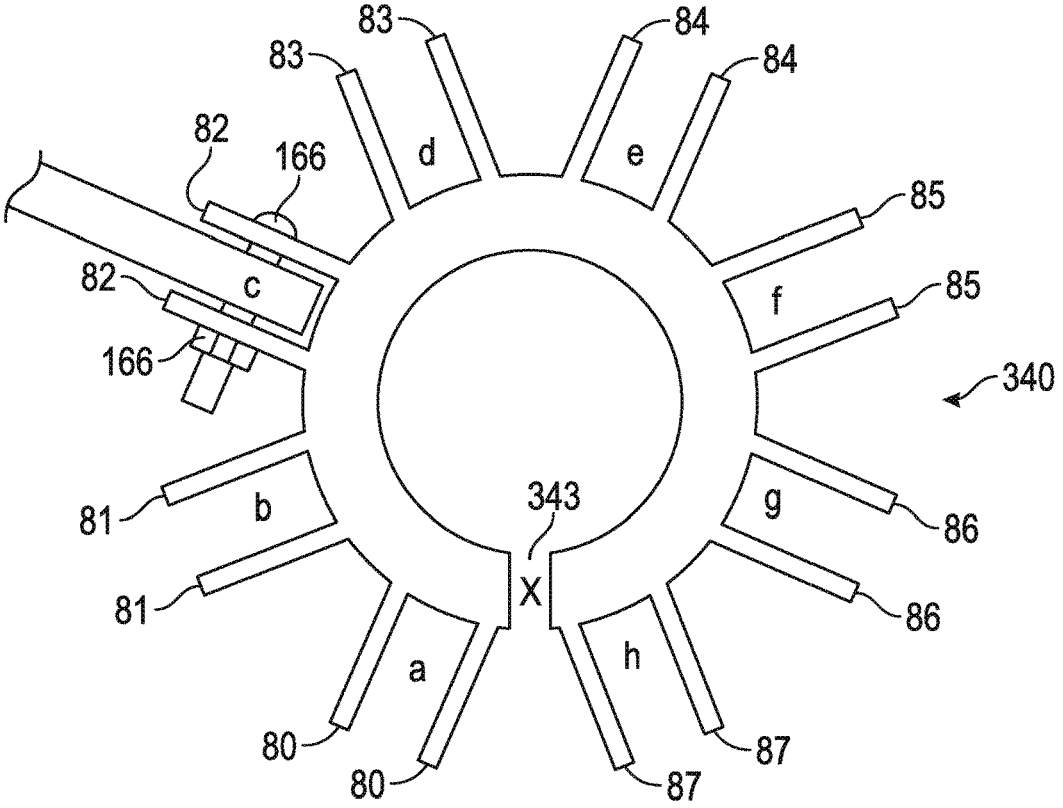
FIG. 9 shows a lower canopy support having pairs of stays configured for pivotably attaching the struts and actuator corresponding to the frame design in FIG. 7.

When the actuator 10, 20 is in the raised position, the upper actuator arm 128 may lay against the outer side of the lower canopy support 140, 240 between pairs of stays 40, 47; 60, 67 supporting lower strut arms 160, 260, as shown in FIGS. 3 and 6. Alternatively, the lower canopy support 340 may be designed having a vertical slice removed so as to form a channel 343 running from its top to its bottom and exposing the sliding rail 114, thus enabling the upper actuator arm 228 to pass through the lower canopy support 340, as shown in FIG. 9. The canopy supports are configured in accordance with whether the strut arms 160, 162; 260, 262 and/or actuator arms 126, 128; 226, 228 are adjacently or centrally connected. In some configurations, the actuator 20 may oppose the sliding rail 114 when in the raised position, and in other configurations the actuator 10 may be in a position adjacent to the sliding rail 114.

In a preferred embodiment, the upper 228 and lower 226 actuator arms are pivotably connected centrally and in alignment with the sliding rail 114, as shown in FIGS. 7, 8, 9, and 12. Both actuator arms 226, 228 contain a channel 132, 134 running along their lengths and opposing one another. The channel 132 in the lower actuator arm 226 faces upward, while the channel 134 in the upper actuator arm 228 faces downward. FIG. 1A shows the underside of the upper actuator arm shown in FIG. 7 so that the channel 134 is visible. The width of the lower actuator arm 226 is preferably wider than that of the upper actuator arm 228 such that when the arms are centrally connected, the upper actuator arm 228 folds into the channel 132 in the lower actuator arm 226 when they are in the raised position. Likewise, the width of the upper actuator arm 228 is preferably wider than that of the sliding rail 114 such that when the actuator 20 is in the raised position, the upper actuator arm 228 accepts the sliding rail 114 into its channel 134, resulting in a snug fit of the actuator 20 against the pole 108.

The lower actuator arm 126, 226 may include a handle 198 on its underside, at the outer end for maximum leverage. When the actuator 10, 20 is in the raised position, this handle 198 is used to guide the actuator 10, 20 downward, thus raising the internal weight 190 in the pole 108 and lowering the canopy 168.

A magnet 196 may be placed near the handle 198, on the underside of the outer end of the lower actuator arm 126, 226. Depending on the strength of the magnet 196 and the method of placement on the lower actuator arm 126, 226, it may be preferable to position a hole (not shown) in the lower actuator arm 126, 226 opposite the magnet 196. The magnet 196 attracts the upper actuator arm 126, 228 when the actuator 10, 20 is in the raised position, thus securing the position and preventing any downward drift of the actuator 10, 20 resulting from the substantially counterbalanced weight system, especially on windy days when the canopy 168 may be shifting.

A lower actuator arm fastener (not shown) may be used to secure the lower actuator arm 126, 226 to the table and to maintain it in the lowered position, especially in windy conditions. In one embodiment, the handle 198 may be configured to attach to the peripheral edge of the table or underside thereof, where the table top is of sufficient diameter for its outer edges to terminate at or near the handle 198. Alternatively, a separate fastener may be attached to the lower actuator arm 126, 226 in a manner that does not interfere with the function of the lower actuator arm channel 132. Preferably, the fastener is movable along the lower actuator arm 126, 226, and it is adjustable in length to accommodate for table tops of various size and height. As an exemplary embodiment, a strap, bungee cord, or tie-down adjustable in position and length is attached to the lower actuator arm 126, 226. The other end of the strap terminates in a wide hook, the tip of which is placed on the underside of the table at the peripheral edge. In another embodiment, a carabiner is used rather than a hook, which may be attached to the underside of the table on existing framework or with a specially placed loop. Any suitable fastener mechanism may be used, such as a pin and hole, clasp mechanism, latch mechanism, etc.

The upper strut arms 162, 262 extend from the outer edges of the canopy 168 converging toward the pole 108, terminating at substantially evenly spaced pivot connections 166 to the upper canopy support 148, 248, 348. The lower strut arms 160, 260 extend from their pivot connections 164, 264 with their corresponding upper strut arms 162, 262, converging toward the pole 108 and terminating at substantially evenly spaced pivot connections 166 with the lower canopy support 140, 240, 340. The pivot connections 166 extend through the upper 162, 262 and lower 164, 264 strut arms, forming axles about which the upper 162, 262 and lower 164, 264 strut arms rotate. FIG. 9 shows a representative pivot connection 166.

Canopy supports come in a wide variety of shapes and styles, all of which are readily apparent to any person having ordinary skill in the art. The upper 148, 248, 348 and lower 140, 240, 340 canopy supports should have an inner surface shape substantially the same as that of the pole 108. In a preferred embodiment, the inner surface shape is substantially cylindrical to fit a cylindrical pole 108, and includes a rail groove 146, 154 to accommodate a sliding rail 114. The inner surface of the upper 148, 248, 348 and lower 140, 240, 340 canopy supports have a diameter slightly larger than that of the combined pole 108 and sliding sleeve 136, as described further herein, to enable attachment to the sliding sleeve 136 situated between the upper 148, 248, 348 and lower 140, 240, 340 canopy supports and the pole 108.

The outer configuration of the upper 148, 248, 348 and lower 140, 240, 340 canopy supports should be sufficient to reasonably enable permanent attachment of one or more pulley cables 180 to the upper canopy support 148, 248, 348, and pivotable attachment of substantially evenly spaced upper 162, 262 and lower 164, 264 strut arms to the upper 148, 248, 348 and lower 140, 240, 340 canopy supports. In the case of the upper canopy support 148, 248, 348, its configuration also should enable pivotable attachment of the upper actuator arm 128, 228, as described more fully herein The upper 148, 248, 348 and lower 140, 240, 340 canopy supports each may include a neck portion 150, 142; 250, 242 at their respective bases.

In one embodiment, each upper 162, 262 and lower 164, 264 strut arm is pivotably connected between a pair of stays 30-38, 40-47, 50-58, 60-67, 70-77, 80-87 radiating outward from the central portion of the upper and lower 140, 240, 340 canopy supports. In this embodiment, the distance between the stays 30-38, 40-47, 50-58, 60-67, 70-77, 80-87 in each pair is slightly larger than the width of the corresponding upper 162, 262 or lower 164, 264 strut arm, enabling freedom of movement of the upper 162, 262 and lower 164, 264 strut arm around the strut arm stay connectors 166 while also providing stability. The strut arm stay connectors 166 extend through both stays in the stay pair 30-38, 40-47, 50-58, 60-67, 70-77, 80-87 and the corresponding upper 162, 262 and lower 164, 264 strut arm. Each stay pair 30-38, 40-47, 50-58, 60-67, 70-77, 80-87 and upper 162, 262 or lower 164, 264 strut arm combination may have a separate pivot connector 166. In an alternate embodiment, a single pivot connector, for example a ring-shaped connector (not shown), may form a continuous connector for all of the upper 162, 262 and lower 164, 264 strut arm/stay pair 30-38, 40-47, 50-58, 60-67, 70-77, 80-87 combinations. In another embodiment, the area between each stay pair 30-38, 40-47, 50-58, 60-67, 70-77, 80-87 constitutes an outward extension of the central portion of the canopy support so as to aesthetically hide the pivot connection(s) and to minimize the appearance of the protruding stays.

In one embodiment, the upper actuator arm 128 is pivotably connected to the upper canopy support 148, 248 between a pair of stays 38, 58 at the same level as the upper strut arm stay pairs 30-37, 50-57 corresponding to the upper strut arms 162, 262. In another embodiment, the upper actuator arm 128, 228 is pivotably connected to a side of the neck 150, 250 portion of the upper canopy support 348 at a level lower than the strut arm stay pairs 30-37, 50-57 corresponding to the upper strut arms 162, 262, either directly on the wall of the neck 150, 250 or between an additional pair of stays (not shown). In another embodiment, the upper actuator arm 128, 228 is pivotably connected to the upper canopy support on the bottom of the neck 150, 250 of the upper canopy support 348. Additional embodiments include pivotal connection of the upper actuator arm 128, 228 recessed in an upper canopy support neck groove 156 on the side of and/or or under the upper canopy support neck 150, 250. In this embodiment, an upper canopy support neck groove pivot connector extends horizontally from one side of the upper canopy support neck 150, 250, through the neck groove 156 and the upper actuator arm 128, 228, to the opposing side of the upper canopy support neck 150, 250. The upper canopy neck groove connector forms an axle about which the upper actuator arm 128, 228 rotates.

Placement of the stay pairs 30-38, 40-47, 50-58, 60-67, 70-77, 80-87 and strut arm stay pivot connectors 166 for the upper 162, 262 and lower 160, 260 strut arms on the upper 148, 248, 348 and lower 140, 240, 340 canopy supports depends on: a) the number of substantially evenly spaced struts 90, 92 around the circumference of the upper 148, 248, 348 and lower 140, 240, 340 canopy supports; b) the location of the connection of the upper actuator arm 128, 228 to the upper canopy support 148, 248, 348; and whether the strut arms 160, 162; 260, 262 and/or actuator arms 126, 128; 226, 228 are pivotably connected adjacently or centrally.

Figure 2:
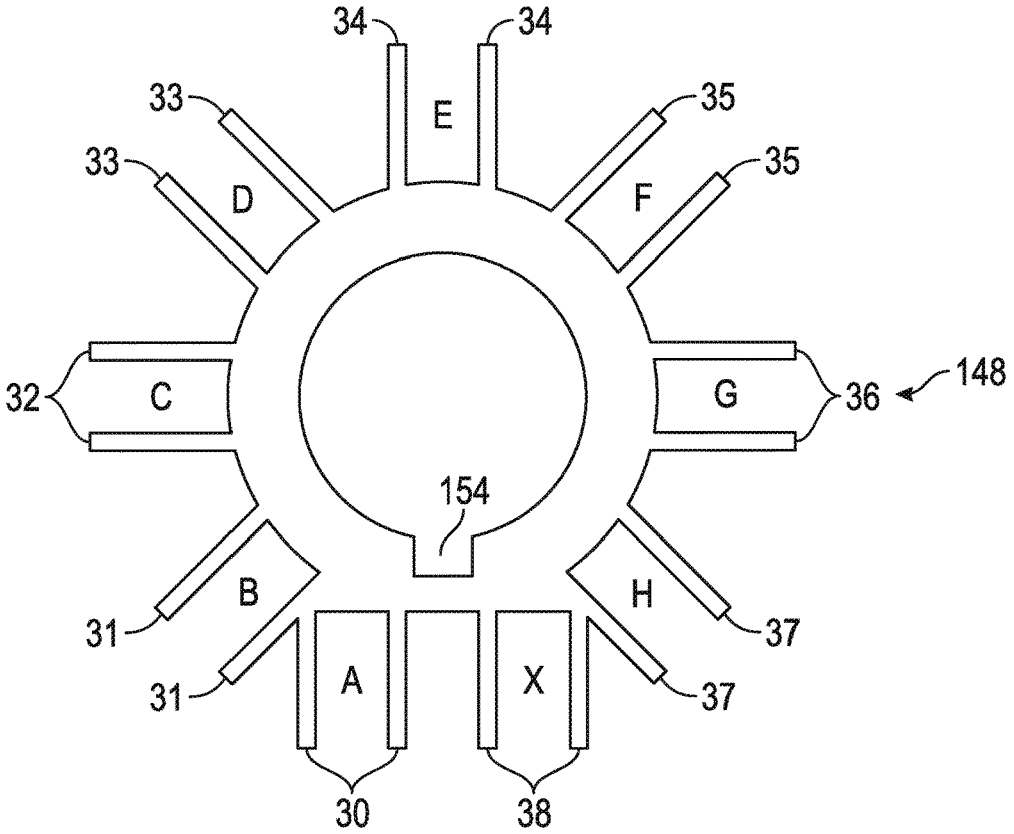
FIG. 2 shows an upper canopy support having pairs of stays configured for pivotably attaching the struts and actuator corresponding to the frame design in FIG. 1.

In an example shown in FIGS. 2 and 3, the upper 148 and lower 140 canopy supports are configured to accommodate eight struts 90, each comprised of upper 162 and lower 160 strut arms joined adjacently at pivot connection 164, the actuator 10 is comprised of upper 128 and lower 126 actuator arms joined adjacently at pivot connection 130, and the upper actuator arm 128 is connected to the upper canopy support 148 between a stay pair 38 at the same level as those used with the upper strut arms 162. In this example, the position of the upper actuator arm 128 is represented by X, which is pivotably connected between stay pair 38, and the upper strut arms 162 are pivotably connected to the upper canopy support 148 at positions A-H between stay pairs 30-37. The lower strut arms 160 are pivotably connected to the lower canopy support 140 at positions a-h between stay pairs 40-47, which are offset from positions A-H and stay pairs 30-37 to accommodate for the adjacent pivot connection 164 of the upper 162 and lower 160 strut arms. When the actuator 10 is in the raised position, the upper actuator arm 128 rests along the outer side of the lower canopy support 140. In this example, the lower canopy support 140 is configured to accommodate the upper actuator arm 128 at position X when it is in the raised position.

Figure 5:
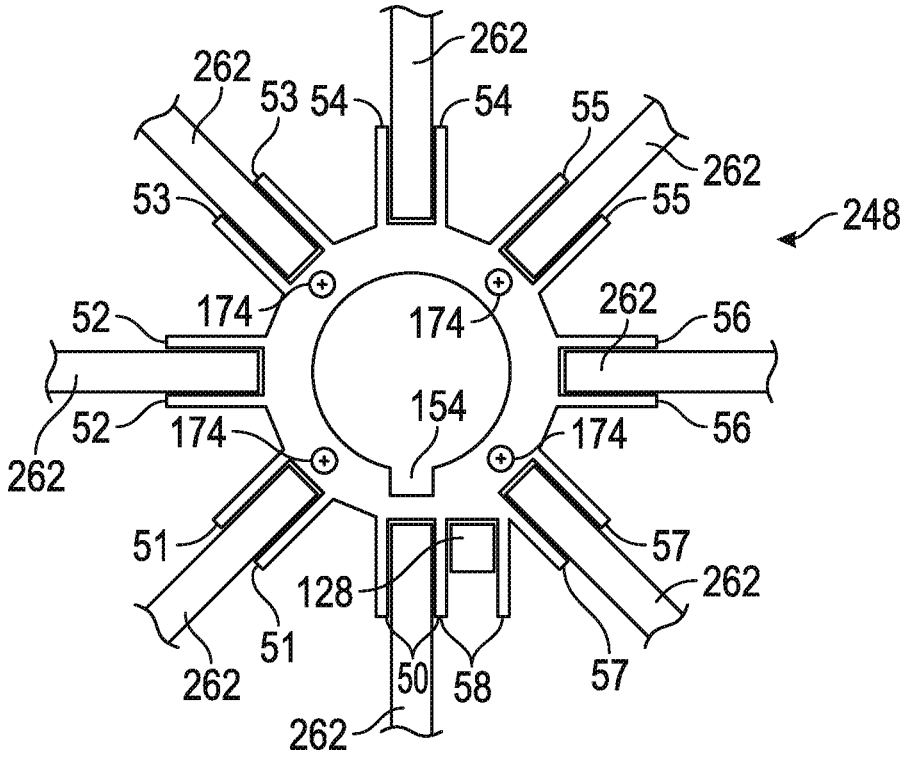
FIG. 5 shows an upper canopy support having pairs of stays configured for pivotably attaching the struts and actuator corresponding to the frame design in FIG. 4.

In an example shown in FIGS. 5 and 6, the upper 248 and lower 240 canopy supports are configured to accommodate eight struts 92 comprised of upper 262 and lower 260 strut arms centrally joined at pivot connection 264, the actuator 10 is comprised of upper 128 and lower 126 actuator arms adjacently joined at pivot connection 130, and the upper actuator arm 128 is connected to the upper canopy support 248 between a stay pair 58 at the same level as the upper strut arms 262. In this example, the upper actuator arm 128 is pivotably connected between stay pair 58, and the upper strut arms 262 are pivotably connected to the upper canopy support 248 between stay pairs 50-57 57. The lower strut arms 260 are pivotably connected to the lower canopy support 240 between stay pairs 60-67. When the actuator 10 is in the raised position, the upper actuator arm 128 rests along the lower canopy support 240. In this example, the lower canopy support 240 is configured to accommodate the upper actuator arm 128 in the raised position.

Figure 8:
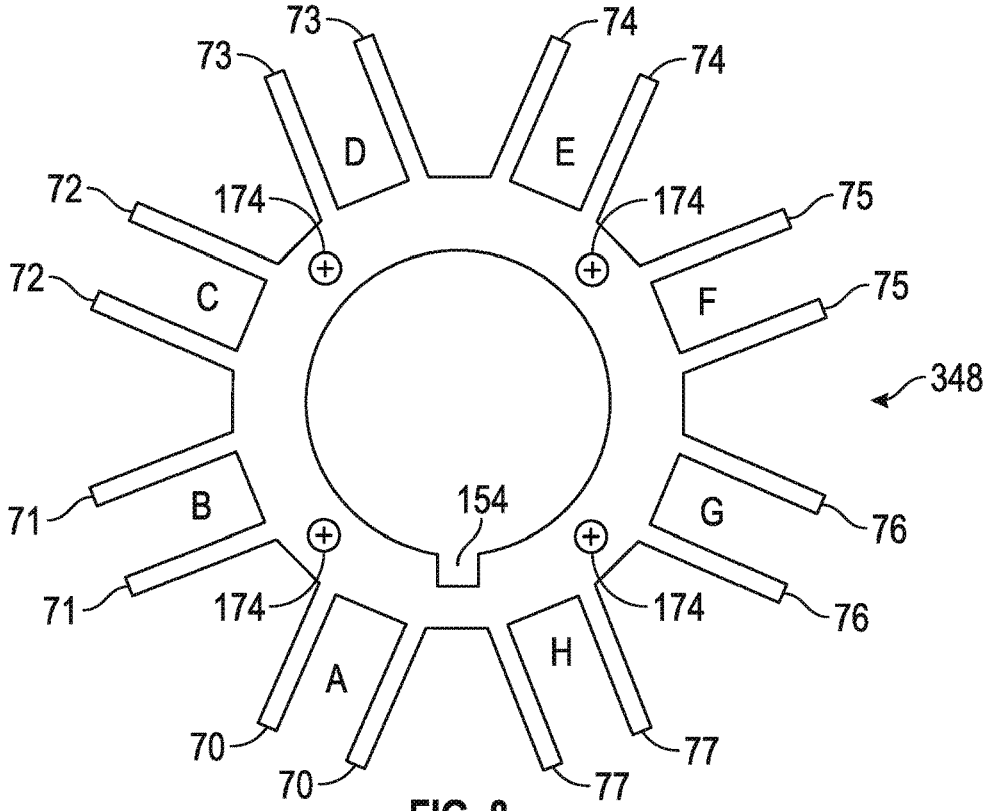
FIG. 8 shows an upper canopy support having pairs of stays configured for pivotably attaching the struts and actuator corresponding to the frame design in FIG. 7.

In an example shown in FIGS. 8 and 9, the upper and lower 340 canopy supports are configured to accommodate eight struts 92 comprised of upper 262 and lower 260 strut arms connected centrally at pivot connection 264, the actuator 20 is comprised of upper 228 and lower 226 actuator arms joined centrally at pivot connection 230, and the upper actuator arm 228 is connected to the upper canopy support 348 in the upper canopy support neck groove 156, at a level below the upper strut arms. In this example, the upper canopy support neck groove pivot connection of the upper actuator arm 228 to the upper canopy support 348 is not visible, and the upper strut arms 262 are pivotably connected to the upper canopy support 348 at positions A-H between stay pairs 70-77. The lower strut arms 260 are pivotably connected to the lower canopy support 340 at positions a-h between stay pairs 80-87. This configuration shows a vertical slice extending through the lower canopy support 340 to create lower canopy support channel 343 exposing the sliding rail 114 through the lower canopy support channel 343. The actuator 20 is positioned so that when it is in the raised position, it rests in the channel 343 of the lower canopy support 340, with the sliding rail 114 in the upper actuator arm channel 134.

In view of the foregoing non-restrictive examples, it should be appreciated that any person having ordinary skill in the art could configure an appropriate pair of upper and lower 140, 240, 340 canopy supports based upon the disclosure herein.

The upper canopy support 148, 248, 348, the lower canopy support 140, 240, 340, and the sliding sleeve 136 are connected such that the distance between the upper 148, 248, 348 and lower 140, 240, 340 canopy supports remains fixed, enabling operation of the actuator 10, 20 to result in raising and lowering of the canopy 168 while it remains fully extended. The sliding sleeve 136 should be substantially the same shape as the pole 108 except that it is discontinuous, having a vertical channel 138 along its entire length to expose the sliding rail 114. The inner circumference of the sliding sleeve 136 is slightly larger than that of the pole 108 around which it is fitted, to enable the sleeve to slide freely along the pole 108. The width of the sliding sleeve channel 138 is slightly larger than the width of the sliding rail 114.

As shown in FIG. 12, the upper canopy support 148, 248, 348 is connected to the sliding sleeve 136 with at least one reversible upper canopy support connector 152, for example, a screw. In embodiments wherein the lower canopy support 140, 240 is continuous, it may be connected to the sliding sleeve 136 in the same manner as the upper canopy support 148, 248, 348. In embodiments wherein the lower canopy support 340 includes a lower canopy support channel 343, at least two reversible lower canopy support connectors 244 should be employed on either side of the channel 343. The length of the upper 152 and lower 144, 244 connectors should be short enough so as not to come into contact with the pole 108.

It may be preferable to use a quick-release means for the lower canopy support connector(s) 244, as it/they must be removed in order to slide the lower canopy support 140, 240, 340 off the sliding sleeve 136 and to increase the distance between the upper 148, 248, 348 and lower 140, 240, 340 canopy supports, thereby collapsing the canopy 168.

When the upper 148, 248, 348 and lower 140, 240, 340 canopy supports are connected to the sliding sleeve 136, the sliding sleeve 136 should extend from the top of the upper canopy support 148, 248, 348 to the bottom of the lower canopy support 140, 240, 340. The length of the sliding sleeve 136 and the corresponding distance between the upper 148, 248, 348 and lower 140, 240, 340 canopy supports is determined prior to connecting the upper 148, 248, 348 and lower 140, 240, 340 canopy supports to the sliding sleeve 136. The upper 148, 248, 348 and lower 140, 240, 340 canopy supports should be situated on the pole 108, and all of the upper 162, 262 and lower 160, 260 strut arms should be connected thereto. By fully extending the canopy 168, the struts 90, 92 guide the upper 148, 248, 348 and lower 140, 240, 340 canopy supports to their proper positions for maintaining full extension of the canopy 168. The distance between the upper 148, 248, 348 and lower 140, 240, 340 canopy supports can be recorded, and the length of the sliding sleeve 136 determined accordingly.

Figure 17:
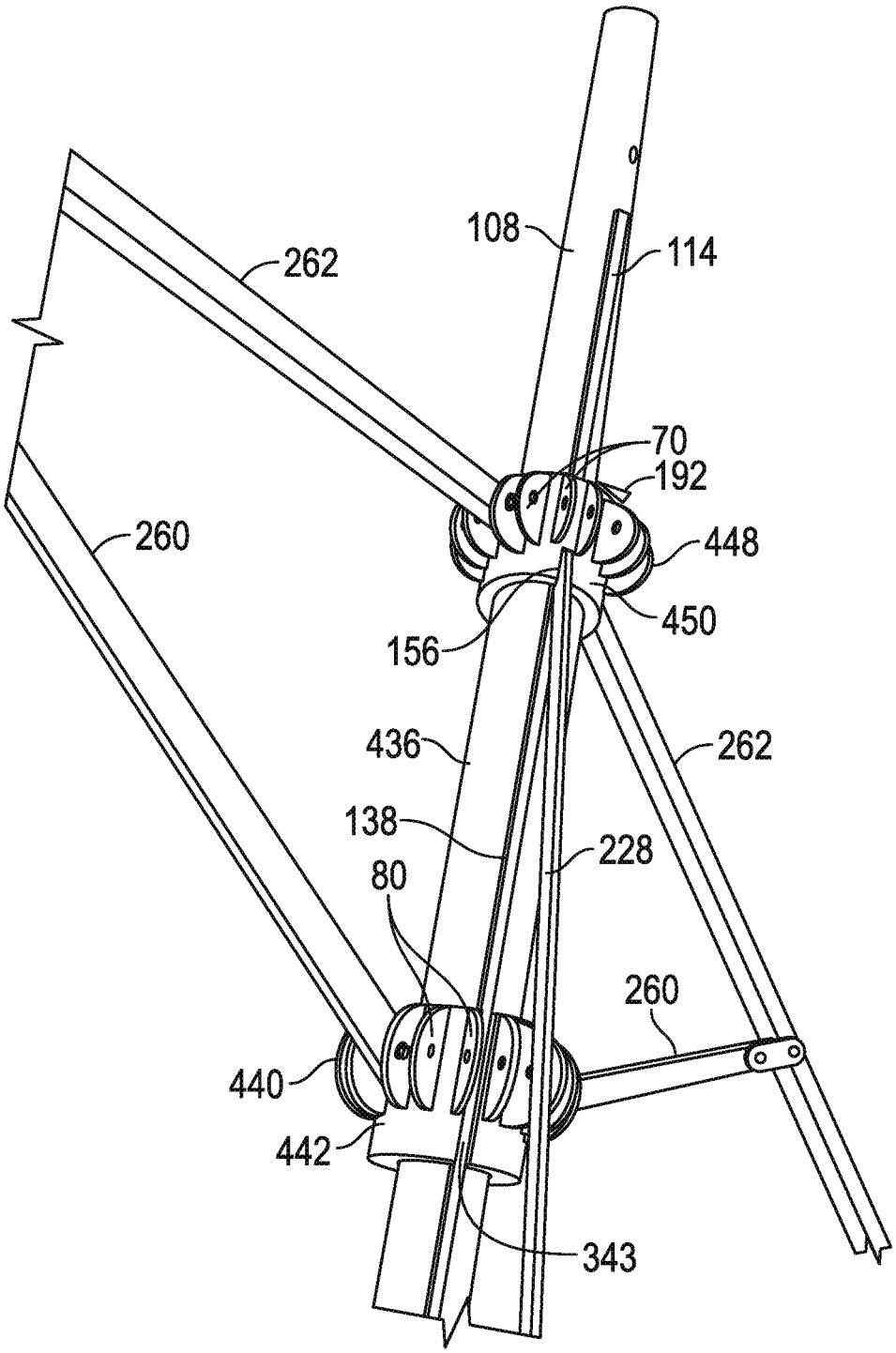
FIG. 17 shows an alternate embodiment of the sliding sleeve, upper canopy support, and lower canopy support manufactured as a single unit.

When the upper 148, 248, 348 and lower 140, 240, 340 canopy supports are connected to the sliding sleeve 136, they operate as a single unit sliding up and down the pole 108 in response to operation of the actuator 10, 20.Once the distance between the upper canopy support 448 and lower canopy support 440 is determined, they may be manufactured together with the sliding sleeve 436 as a single unit, as shown in FIG. 17. In this embodiment, the distance between the upper 448 and lower 440 canopy supports remain fixed, and the canopy 168 cannot be collapsed. The need for upper canopy support connector 152 and lower canopy support connector(s) 144, 244 is eliminated. Alternatively, the upper canopy support neck 450 is extended as sliding sleeve 436 and joined to the top of the lower canopy support 440.

Figure 18:
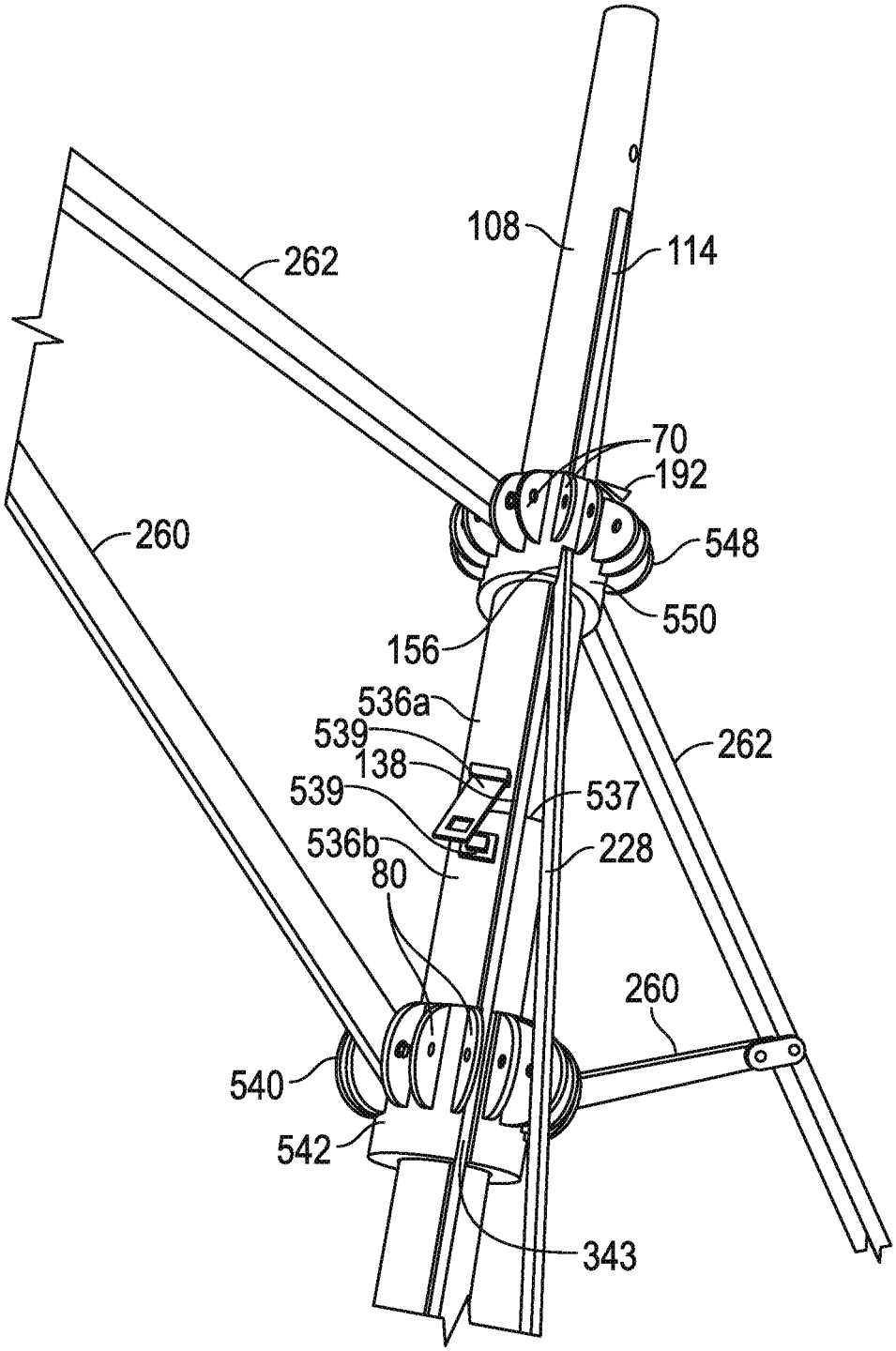
FIG. 18 shows an alternate embodiment of a bifurcated sliding sleeve, wherein the upper portion of the sliding sleeve and the upper canopy support are manufactured as a unit, and the lower portion of the sliding sleeve and the lower canopy support are manufactured as a unit.

In yet another embodiment shown in FIG. 18, the sliding sleeve is bifurcated. The upper portion of the sliding sleeve 536*a* is manufactured as a single piece together with upper canopy support 548, and the lower portion of the sliding sleeve 536*b* is manufactured together as a single piece together with lower canopy support 540. The bottom of sliding sleeve 536*a* and top of sliding sleeve 536*b* meet at bifurcated sliding sleeve interface 537. Alternatively, the upper canopy support neck 550 is extended as sliding sleeve 536*a* and the top of the lower canopy support 540 is extended as sliding sleeve 536*b* so that the bottom of sliding sleeve 536*a* and top of sliding sleeve 536*b* meet at bifurcated sliding sleeve interface 537. When sliding sleeves 536*a* and 536*b* meet at the bifurcated sliding sleeve interface 537, the total length of the sliding sleeves 536*a* and 536*b* maintains the proper distance between the upper canopy support 548 and the lower canopy support 540. This two-piece design allows the two portions of the sliding sleeve 536*a* and 536*b* to be separated, enabling the canopy 168 to be collapsed. This embodiment also eliminates the need for upper canopy support connector 152 and lower canopy support connector (s) 144, 244. However, the two portions of the sliding sleeve 536*a* and 536*b* meeting at the bifurcated sliding sleeve interface 537 must be maintained in place when the canopy 168 is raised. This is accomplished by using a bifurcated sliding sleeve connector 539 of any reasonable configuration, such as one that joins the two portions directly, example of which include, but are not limited to a clasp mechanism, a latch mechanism, magnetic connectors, nut and bolt pair, etc. Alternatively, a bifurcated sliding sleeve connector 539 includes configurations that attach each of the two portions of the sliding sleeve 536*a* and 536*b* independently to the pole 108 in the proper so that they meet at the bifurcated sliding sleeve interface 537, examples of which include, but are not limited to screws, pins, adjustable collars, etc. In one example, shown in FIG. 18, the two portions of the sliding sleeve 536*a* and 536*b* meeting at the bifurcated sliding sleeve interface 537 are maintained in place using a latch mechanism, each opposing portion of the latch mechanism being situated on either side of the bifurcated sliding sleeve interface 537 on the respective portions of the sliding sleeve 536*a* and 536*b*.

COMPONENT LIST

| Ref. No. | Component |
|---|---|
| 102 | Base |
| 104 | Base fitting sleeve |
| 106 | Base tightening screw |
| 108 | Pole |
| 110 | Upper stop tab |
| 112 | Lower stop tab |
| 114 | Sliding rail |
| 116 | Sliding rail notch |
| 118 | Tilting mechanism |
| 120, 220 | Lower actuator arm support |
| 122, 222 | Lower actuator arm support mounting hole |
| 124 | Lower actuator arm support connector |
| 126, 226 | Lower actuator arm |
| Not shown | Lower actuator arm fastener |
| 128, 228 | Upper actuator arm |
| 130, 230 | Actuator arm pivot connector |
| 132 | Lower actuator arm channel |
| 134 | Upper actuator arm channel |
| 10, 20 | Actuator |
| 136, 436 | Sliding sleeve |
| 138 | Sliding sleeve channel |

-continued

COMPONENT LIST

| Ref. No. | Component |
|---|---|
| 140, 240, 340, 440, 540 | Lower canopy support |
| 142, 242, 442, 542 | Lower canopy support neck |
| 343 | Lower canopy support channel |
| 144, 244 | Lower canopy support connector(s) |
| 146 | Lower canopy support rail groove |
| 148, 248, 348, 448, 548 | Upper canopy support |
| 150, 250, 450, 550 | Upper canopy support neck |
| 152 | Upper canopy support connector |
| 154 | Upper canopy support rail groove |
| 156 | Upper canopy support neck groove |
| Not shown | Upper canopy support neck groove connector |
| Not numbered individually | Stays |
| 30-38, 40-47, 50-58, 60-67, 70-77, 80-87 | Stay pairs |
| 160, 260 | Lower strut arm(s) |
| 162, 262 | Upper strut arm(s) |
| 90, 92 | Strut(s) |
| 164, 264 | Strut arm pivot connector(s) |
| 166 | Strut arm stay connector(s) |
| 168 | Canopy |
| 170 | Canopy hole |
| Not shown | Strut pockets(s) |
| 172 | Vent flap |
| 174 | Vent flap snap closures(s) |
| 176 | Valence |
| 178 | Skirt |
| Not shown | Skirt secure(s) |
| Not shown | Skirt attachment |
| 180 | Skirt opening |
| Not shown | Skirt hem |
| Not shown | Skirt hem secure(s) |
| Not shown | Skirt container(s) |
| 180 | Cable(s) |
| Not shown | Cable connectors(s) |
| 182 | Pulley opening(s) |
| 184 | Pulley(s) |
| 186 | Pulley guard(s) |
| 188 | Pulley mount(s) |
| 190 | Weight |
| 192 | Ballast weight(s) |
| 194 | Ballast connector(s) |
| 196 | Magnet |
| Not shown | Magnet hole |
| 197 | Finial/cap |
| 198 | Handle |
| 225 | Lower actuator arm/sliding rail interface |
| 537 | Bifurcated sliding sleeve interface |
| 539 | Bifurcated sliding sleeve connector |
| 536a | Bifurcated sliding sleeve upper portion |
| 536b | Bifurcated sliding sleeve lower portion |
| 400, 600 | Stabilizing finial |
| 402 | Stabilizing finial base |
| 404 | Stabilizing finial top |
| 406 | Stabilizing finial inner recess |
| 407 | Stabilizing finial plug |
| 408, 608 | Stabilizer |
| 409 | Sealing edge |
| 410, 610 | Stabilizer canal |
| 611 | Stabilizer ridge |
| 673 | Stabilizer slot |
| 675, 676 | Stabilizer legs |
| 677 | Stabilizer leg grooves |

The invention claimed is:

1. Framework for an umbrella comprising:

a. A hollow pole comprising a cylindrical wall having inner and outer sides having a top portion, an elongated middle portion, and a bottom portion, the outer side of the cylindrical wall having fixed thereon a sliding rail having a top end positioned at about the bottom of the top portion of the pole and extending vertically downward to a lower actuator arm support positioned on the pole at about the top of its bottom portion, the cylindrical wall further having at least one pulley opening extending from its outer side to its inner side in the top portion of the pole above the sliding rail;

b. A moveable, discontinuous cylindrical sliding sleeve having an inner side opposing the outer side of said pole, wherein a vertical channel slightly wider than said sliding rail extends along the length of the sliding sleeve, and wherein the vertical channel is aligned along said sliding rail;

c. An upper canopy support and a lower canopy support, each having a top and a bottom, each having a substantially cylindrical inner shape, and each being attached to said sliding sleeve so as to maintain a fixed distance therebetween, wherein said sliding sleeve extends from the bottom of the inner side of the lower canopy support to the top inner side of the upper canopy support;

d. Struts, each comprising a long upper strut arm pivotably connected to a short lower strut arm, wherein each long upper strut arm has a terminal end pivotably connected to said upper canopy support, and wherein the struts are spaced at substantially even intervals around said upper canopy support; and wherein each lower strut arm terminates on one end at the pivot connection with its corresponding upper strut arm, and terminates at its other end at a pivotable connection to said lower canopy support;

e. An actuator comprising a lower actuator arm pivotably connected to an upper actuator arm, wherein the lower actuator arm is pivotably connected at one end to said lower actuator arm support and extends outward, and wherein the upper actuator arm has a two ends, a first end terminating at a pivotable connection to the lower actuator arm, and a second end terminating at a pivotable connection to said upper canopy support;

f. At least one pulley system having a cable and a pulley, wherein the pulley is mounted vertically in said hollow pole and extends outward through said at least one pulley opening, and wherein the cable has two ends, a first end being attached to said upper canopy support, and a second end extending over the pulley and downward into said inner side of said hollow pole; and g. At least one counterbalance weight, the at least one counterbalance weight being attached to said second end of said cable in said inner side of said hollow pole.

2. The framework of claim 1, wherein the upper canopy support and the lower canopy support are reversibly fixed to said sliding sleeve.

3. The framework of claim 1, wherein the upper canopy support, the lower canopy support, and the sliding sleeve comprise a single unit.

4. The framework of claim 3, wherein the unit is bifurcated at its mid-section, and further comprises a sliding sleeve connector capable of maintaining a fixed distance between the upper canopy support and the lower canopy support of the bifurcated unit.

5. The framework of claim 1, wherein the inner shape of the upper and lower canopy supports comprises a rail groove opposing the sliding rail and accepting it therein.

6. The framework of claim 1, wherein the upper and lower canopy supports each comprise a neck extending from their bottoms, each neck having substantially the same inner shape as its corresponding canopy support.

7. The framework of claim 6, wherein the upper actuator arm is pivotably connected to the neck of the upper canopy support.

8. The framework of claim 1, wherein the upper and lower canopy supports each comprise a pair of stays on either side of the strut arms pivotably connected thereto.

9. The framework of claim 1, wherein the upper actuator arm is pivotably connected to the upper canopy support between a pair of stays.

10. The framework of claim 1, wherein the lower canopy support is discontinuous, comprising a channel extending vertically from top to bottom for accommodating at least one of the sliding rail and the actuator in the raised position.

11. The framework of claim 10, wherein the lower actuator arm further comprises a channel in its topside, wherein the upper actuator arm is pivotably connected to the lower actuator arm in the lower actuator arm channel, wherein the upper actuator arm further comprises a channel in its bottomside, and wherein raising the actuator results in the sliding rail residing in the upper actuator arm channel, and the upper actuator arm residing in the lower actuator arm channel.

12. The framework of claim 1, wherein the lower actuator arm support is welded to the pole.

13. The framework of claim 1, further comprising external ballast weight.

14. The framework of claim 1, wherein the pole further comprises a tilting mechanism.

15. The framework of claim 1, further comprising a stabilizing finial having a) a plug for resting on top of the hollow pole; b) a stabilizer extending into said hollow pole, said stabilizer having a canal that fits around the uppermost one or more pulley's top and sides; and c) a base extending downward on the outside of said pole to shield said one or more pulley openings.

16. The framework of claim 1, further comprising a stabilizing finial having a) a plug for resting on top of the hollow pole; b) a stabilizer extending into said hollow pole, said stabilizer having two pairs of flexible legs, each pair of legs being symmetrically opposed around an axis formed by an uppermost pulley mount extending horizontally through said pole, wherein each leg comprises a leg groove for housing the uppermost pulley mount when the stabilizer is fully inserted into said pole, and c) a base extending downward on the outside of said pole to shield said one or more pulley openings.

17. The framework of claim 1, wherein said outer side of said pole further comprises a lower stop tab located at said bottom of said lower canopy support when said actuator is fully lowered.

18. The framework of claim 1, further comprising a base for accepting said bottom portion of said pole.

19. The framework of claim 1, further comprising a magnet on the underside outer end of said lower actuator arm.

20. The framework of claim 1, wherein said lower actuator arm further comprises a fastener for maintaining said actuator in a lowered position.

21. The framework of claim 1, further comprising a handle on the underside outer end of the lower actuator arm.

* * * * *